US007288354B2

(12) United States Patent
Moribe et al.

(10) Patent No.: US 7,288,354 B2
(45) Date of Patent: Oct. 30, 2007

(54) TONER

(75) Inventors: Shuhei Moribe, Shizuoka (JP); Nobuyuki Okubo, Shizuoka (JP); Tsutomu Onuma, Kanagawa (JP); Hideto Iida, Chiba (JP); Koji Nishikawa, Shizuoka (JP); Takashige Kasuya, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 381 days.

(21) Appl. No.: 10/902,072

(22) Filed: Jul. 30, 2004

(65) Prior Publication Data

US 2005/0048390 A1 Mar. 3, 2005

(30) Foreign Application Priority Data

Aug. 1, 2003 (JP) ..... 2003-205315

(51) Int. Cl.
*G03G 9/00* (2006.01)

(52) U.S. Cl. ..... 430/110.3; 430/110.1; 430/109.3; 430/110.4

(58) Field of Classification Search ..... 430/109.3, 430/108.1, 110.3, 110.4, 111.4, 110.1
See application file for complete search history.

(56) References Cited

U.S. PATENT DOCUMENTS

| | | | | |
|---|---|---|---|---|
| 5,240,803 | A | 8/1993 | Ota | 430/106 |
| 5,342,722 | A | 8/1994 | Ito et al. | 430/109 |
| 5,370,958 | A | 12/1994 | Shin et al. | 430/110 |
| 5,912,101 | A | 6/1999 | Karaki et al. | 430/110 |
| 6,033,817 | A | 3/2000 | Yusa et al. | 430/106.6 |
| 6,630,275 | B2 | 10/2003 | Hiratsuka et al. | 430/106.1 |
| 6,670,087 | B2 * | 12/2003 | Fujikawa et al. | 430/109.2 |
| 7,029,813 | B2 * | 4/2006 | Mikuriya et al. | 430/108.1 |
| 2002/0098438 | A1 * | 7/2002 | Hashizume et al. | 430/124 |
| 2003/0039908 | A1 | 2/2003 | Hiratsuka et al. | 430/106.1 |
| 2003/0198883 | A1 | 10/2003 | Hiratsuka et al. | 430/109.3 |

FOREIGN PATENT DOCUMENTS

| | | |
|---|---|---|
| EP | 1439429 A1 * | 7/2004 |
| GB | 2100873 | 1/1983 |
| JP | 56-116043 | 9/1981 |
| JP | 57-208559 | 12/1982 |
| JP | 02-87157 | 3/1990 |
| JP | 03-84558 | 4/1991 |
| JP | 03-229268 | 6/1991 |
| JP | 04-1766 | 1/1992 |
| JP | 04-102862 | 4/1992 |
| JP | 04-178658 | 6/1992 |
| JP | 06-11890 | 1/1994 |
| JP | 10-87837 | 4/1998 |
| JP | 10-97095 | 4/1998 |
| JP | 11-149176 | 6/1999 |
| JP | 11-202557 | 7/1999 |

* cited by examiner

*Primary Examiner*—Mark R. Huff
*Assistant Examiner*—Peter L. Vajda
(74) *Attorney, Agent, or Firm*—Fitzpatrick, Cella, Harper & Scinto

(57) ABSTRACT

A toner is composed of toner particles including toner base particles containing at least a binder resin and a colorant, and inorganic fine particles. The toner base particles having a specific circle-equivalent diameter as measured with a flow type particle image analyzer have a specific average circularity. The toner base particles have a specific surface roughness as measured with a scanning probe microscope. The binder resin contains at least a vinyl resin having as partial structure a linkage formed by the reaction of a carboxyl group with an epoxy group.

12 Claims, 2 Drawing Sheets

TONER

BACKGROUND OF THE INVENTION

1. Field of the Invention

This invention relates to a toner used in image forming processes for making electrostatic latent images into visible images, such as electrophotography, and a toner used in toner jet recording.

2. Related Background Art

In recent years, machinery making use of electrophotography has begun to be used in printers for computer data output, facsimile machines and so forth in addition to copying machines for copying original images. Accordingly, machines are severely sought to be more compact, more light-weight, more high-speed and more high-reliability, and have come to be constituted of simpler components in various aspects. As a result, it is demanded for toners to have higher performance.

In particular, in respect of energy saving and office space saving, machines such as printers are required to be made more compact. On that occasion, containers which hold toners therein are also necessarily required to be made compact, and a low-consumption toner capable of printing many sheets with a small quantity is required.

Japanese Patent Applications Laid-open No. H3-84558, No. H3-229268, No. H4-1766 and No. H4-102862 disclose that the shape of toner base particles is made close to spherical shape by production processes such as spray granulation, solution dissolution, and polymerization. These methods, however, all require large-scale equipment for the production of toners. This is undesirable in view of production efficiency, and also toners obtained have not achieved sufficient reduction of toner consumption at the time of printing.

Japanese Patent Applications Laid-open No. H2-87157, No. H10-97095, No. H11-149176 and No. H11-202557 disclose that toner base particles produced by pulverization are made to undergo thermal or mechanical impact to modify the shape and surface properties of the toner base particles. However, the modification of the particle shape of toner base particles by these methods can not be said to be sufficient in reducing toner consumption at the time of printing, and also has caused deterioration in developing performance in some cases.

With the achievement of high-speed development and energy saving in recent years, it is also demanded to provide toners that can materialize lower-temperature fixing performance.

The melt behaviour required as toners is (1) to have high melt performance at low temperature and (2) to have high releasability even at high temperature. It is desired to create toners having such properties.

Physical properties given as an index of melt characteristics includes melt viscosity. As characteristics of ideal melt viscosity, it is preferable (1) that the melt start temperature is low and (2) that melt viscosity is kept constant at an appropriate value up to high temperature. In printers making use of a heat-and-pressure fixing system, both the characteristics are important factors because the former (1) is important in order to achieve energy saving and shorten stand-by time for printing, and also in view of an influence on machine surroundings where the electrophotography making use of the heat-and-pressure fixing system is used, and the latter (2) is important in order that the releasability from the heating roller is sufficiently kept even at high temperature and prints are prevented from staining because of adhesion of unfixed toner to the heating roller (i.e., a phenomenon of offset).

Resins having superior low-temperature melting properties may include polyester resins, which, however, though having a low melt start temperature, may greatly lower melt viscosity at high temperature.

Japanese Patent Application Laid-open No. S57-208559 discloses a toner containing a polyester resin and an anti-offset agent. This toner tends to cause some problem in respect of fluidity and agglomerative properties. Also, the polyester resin is difficult to pulverize in a process involving the step of pulverization and is disadvantageous in respect of the productivity of toner base particles produced by pulverization.

On the other hand, resins having superior releasability at high temperature include vinyl resins. The vinyl resins have the properties of readily obtaining high releasability such that the temperature at which the melt viscosity begins to lower is relatively high, but have a relatively high melt start temperature. However, in order to realize good fixing properties, if providing the binder resin with a low molecular weight to lower the temperature at which the melt viscosity begins to lower, a low release effect may result. Even if a release agent is used in vinyl resins with a low molecular weight in order to achieve low-temperature fixing, the melted resins themselves have so low a viscosity as to make it difficult to exhibit the necessary release effect.

Japanese Patent Application Laid-open No. S56-116043 discloses a toner making use of a resin obtained by polymerizing a vinyl monomer in the presence of a reactive polyester resin and allowing the polymer to have a high molecular weight through cross-linking reaction, addition reaction and grafting reaction in the course of polymerization. Further, Japanese Patent No. 2962809 discloses resin compositions for toners which has a polyester resin and a vinyl copolymer.

Toners containing in their toner base particles the vinyl polymer or gel content obtained by such cross-linking reaction may be expected to be improved in anti-offset performance. However, where the vinyl polymer obtained by such cross-linking reaction is used as a toner raw material, a polymer with high viscoelasticity may undergo large shear force at the time of melt kneading in producing toner base particles. This may accelerate the cutting of polymer molecular chains to lower the melt viscosity of the binder resin, and hence lower the anti-offset performance of the toner at the time of heat-and-pressure fixing. Also, the generation of heat because of the cutting of polymer molecular chains may cause a rise in temperature of the polymer itself at the time of melt kneading to make it difficult to achieve good dispersion of components contained in the toner base particles.

Japanese Patent Application Laid-open No. H10-087837 and Japanese Patent No. 3118341 disclose toners in which molecular weight distribution controlled to have a peak in each of a low-molecular weight region and a high-molecular weight region is formed and which have as a binder resin a resin composition constituted of a carboxyl-group-containing vinyl resin and as a cross-linking agent a glycidyl-group-containing vinyl resin.

Although these toners exhibit superior effect on the improvement of anti-offset properties, when using such a cross-linked resin, the resin has a high viscosity at the time of melt kneading, tending to result in coarse particles in producing toner base particles. As a result, the toner making use of the resultant toner base particles tends to cause faulty images due to sleeve coat non-uniformity, and such a tendency is remarkable especially in image forming apparatus of a high-speed development system.

It has been long-awaited to provide a toner which can satisfactorily achieve space saving, high speed and energy saving in printers.

SUMMARY OF THE INVENTION

An object of the present invention is to provide a toner having solved the above problems.

Another object of the present invention is to provide a toner which can enjoy less toner consumption per sheet of images, and can achieve many-sheet printing in a smaller quantity of toner.

Still another object of the present invention is to provide a toner that may cause neither sleeve negative ghost nor spots around line images.

A further object of the present invention is to provide a toner that may cause no blotches on the developing sleeve.

Still further object of the present invention is to provide a toner having superior developing performance and fixing performance even in high-speed image forming apparatus.

To achieve the objects, the present invention provides a toner comprising toner particles which comprise toner base particles containing at least a binder resin and a colorant, and inorganic fine particles, wherein;

the toner base particles having a circle-equivalent diameter of from 3 μm or more to 400 μm or less as measured with a flow type particle image analyzer have an average circularity of from 0.935 or more to less than 0.970;

the toner base particles have an average surface roughness of from 5.0 nm or more to less than 35.0 nm as measured with a scanning probe microscope; and the binder resin contains at least a vinyl resin having as partial structure a linkage formed by the reaction of a carboxyl group with an epoxy group.

DESCRIPTION OF THE PREFERRED EMBODIMENTS

Figure 1:
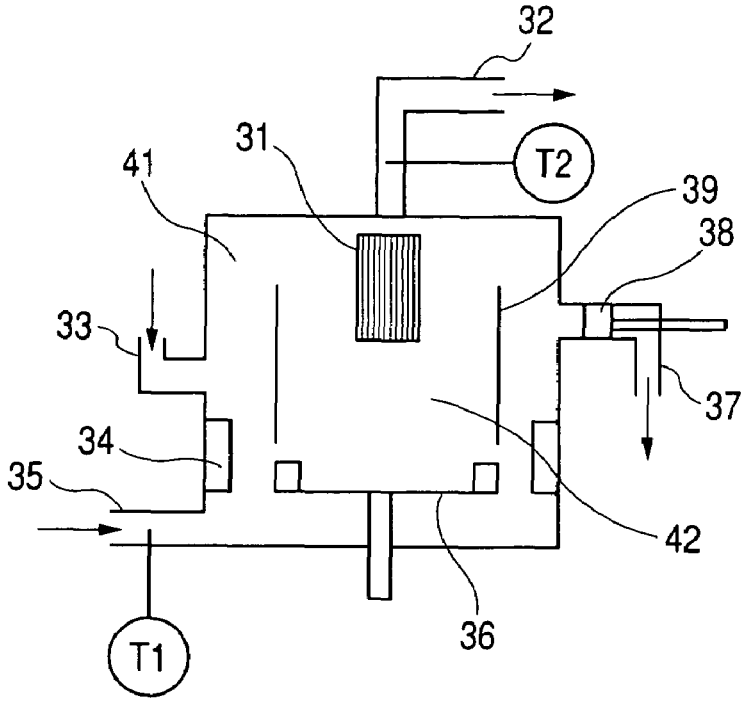
FIG. 1 is a schematic sectional view of an example of a surface modifying apparatus used in the step of surface modification in the present invention.

As a result of extensive studies, the present inventors have discovered that development characteristics of the toner can be controlled by controlling the circularity of toner base particles and also controlling the surface roughness of toner base particles.

In the toner base particles of the present invention, toner base particles having a circle-equivalent diameter of from 3 μm or more to 300 μm or less have an average circularity of from 0.935 or more to less than 0.970, preferably from 0.935 or more to less than 0.965, more preferably from 0.935 or more to less than 0.960, and still more preferably from 0.940 or more to less than 0.955. By virtue of this feature, the toner consumption per image area can be reduced. As the toner base particles have higher circularity, the toner has higher fluidity and hence individual toner particles come to be more easily freely movable. In developing electrostatic latent images formed on an electrostatic latent image bearing member such as an OPC (organic photoconductor) photosensitive member, the toner has a higher probability of contributing to the development of each toner particle as the toner particle has a high circularity, and hence toner images on the electrostatic latent image bearing member have a small height, so that the toner consumption can be reduced. If the circularity of the toner base particles are insufficiently high, the toner tends to behave as agglomerates, and to be moved to the electrostatic latent image bearing member in the form of agglomerates. Such toner images have a large height (i.e., thick), and when contributing to the development in the same area, the toner is moved to the electrostatic latent image bearing member in a quantity larger than a toner having superior fluidity, therefor resulting in large toner consumption. Also, the toner composed of toner base particles having a high circularity can readily create a denser state of toner images. As a result, toner images transferred from the electrostatic latent image bearing member to a transfer material via, or not via, an intermediate transfer member have a high toner coverage on the transfer material, and a sufficient image density can be attained even in a small toner quantity.

If the toner base particles have an average circularity of less than 0.935, the toner images formed have a large height, resulting in large toner consumption. Also, the spaces between toner particles may come to be too large to obtain sufficient coverage also on the toner images formed, and hence, a larger toner quantity is required in order to attain necessary image density, resulting in large toner consumption. If the toner base particles have an average circularity of more than 0.970, the toner may be fed onto the developing sleeve in excess, so that the sleeve may be coated non-uniformly with the toner, consequently tending to cause blotches.

More preferably, in the toner of the present invention, toner base particles having a circle-equivalent diameter of from 3 μm or more to 400 μm or less may have an average circularity of from 0.935 or more to less than 0.970, preferably from 0.935 or more to less than 0.965, more preferably from 0.935 or more to less than 0.960, and still more preferably from 0.940 or more to less than 0.955. In virtue of this feature, the toner consumption per image area can further be reduced. The reason therefor is that the toner can create a denser state of toner images, and hence the toner can cover the transfer material in a high coverage, and can attain a sufficient image density even in a small toner quantity.

If the toner base particles have an average circularity of less than 0.935, large toner consumption may result. If they have an average circularity of 0.970 or more, blotches tend to appear.

In the present invention, it is preferable that the toner particles having a circle-equivalent diameter of from 3 μm or more to 400 μm or less have an average circularity of from 0.935 or more to less than 0.970.

The average circularity referred to herein is used as a simple method for expressing the shape of particles quantitatively, and is determined by measurement using a flow type particle image analyzer FPIA-2100, manufactured by Sysmex Corporation, and in an environment of 23° C. and 60% RH, where particles within the range of from 0.60 μm to 400 μm in circle-equivalent diameter are measured. The circularity of each particle measured is determined from the following equation (1). Further, in the particles having circle-equivalent diameters of from 3 μm or more to 400 μm or less, the sum total of circularities is divided by the number of all particles, and the value found is defined as the average circularity.

$$\text{Circularity } a = L_0/L \quad (1)$$

wherein $L_0$ represents the circumferential length of a circle having the same projected area as a particle image, and L represents the circumferential length of a projected particle image formed when image-processed at an image-processing resolution of 512×512 (pixels of 0.3 μm×0.3 μm each).

The circularity referred to herein is an index showing the degree of surface unevenness of toner base particles (particles to which external additives such as inorganic fine particles have not been added) and the degree of surface unevenness of toner particles (particles to which external additives such as inorganic fine particles have been added, i.e., the toner). It is indicated as 1.000 when the toner base particles and the toner particles have perfectly spherical particle shapes. The more complicated the surface shapes of the toner base particles and toner particles are, the smaller the value of circularity is. The measuring instrument "FPIA-2100" used in the present invention employs a calculation method in which, after calculating the circularity of each toner base particle and each toner particle, according to the resulting circularities, particles are divided into classes where circularities of 0.400 to 1.000 are divided into 61 (0.400 or more to less than 0.410, 0.410 or more to less than 0.420, . . . , 0.980 or more to less than 0.990, 0.990 or more to less than 1.000, and 1.000), and the average circularity is calculated using the center values and frequencies of divided points. However, between the value of the average circularity calculated by this calculation method and the value of the average circularity calculated by the above calculation equation which uses the sum total of circularities of individual particles, there is only a very small error, which is at a level that is substantially negligible. Accordingly, in the present invention, such a calculation method partly modified while utilizing the concept of the calculation equation using the sum total of circularities of individual particles may be used for the reason of handling data, e.g., making the calculation time short and simplifying the operational equation for calculation. In addition, compared with "FPIA-1000" used conventionally to calculate the particle shape of toner base particles and toner particles, the measuring instrument "FPIA-2100" used in the present invention is one which has been improved in precision of measurement of the particle shape of toner base particles and toner particles because of an improvement in magnification of processed particle images and also an improvement in processing resolution of images taken in (256×256→512×512), and thereby having achieved surer capture of fine particles. Accordingly, where the particle shape and particle size distribution must more accurately be measured as in the present invention, FPIA-2100 is more useful providing more accurate information on the particle shape and particle size distribution.

Referring to a specific method for the measurement, 0.1 to 0.5 ml of a surface-active agent, preferably an alkylbenzenesulfonate, as a dispersant is added to 200 to 300 ml of water from which any impurities have previously been removed. To this solution, about 0.1 g to about 0.5 g of a sample for measurement is further added. The resultant suspension in which the sample has been dispersed is subjected to dispersion by means of an ultrasonic oscillator for 2 minutes. Adjusting the dispersion concentration to 2,000 to 10,000 particles/μl, the circularity distribution of particles is measured.

As the ultrasonic oscillator, the following apparatus may be used, for example. Dispersion may be carried out under the following conditions.

UH-150 (manufactured by K.K. SMT).

Output level: 5.

Constant mode.

The summary of measurement is as follows:

The sample dispersion is allowed to pass through channels (extending along the flow direction) of a flat flow cell (thickness: about 200 μm). A strobe and a CCD (charge-coupled device) camera are fitted on the sides opposite to each other with respect to the flow cell so as to form a light path that passes crosswise with respect to the thickness of the flow cell. While the sample dispersion flows, the dispersion is irradiated with strobe light at intervals of 1/30 seconds to obtain images of the particles flowing through the cell, so that a photograph of each particle is taken as a two-dimensional image having a certain range parallel to the flow cell. From the area of the two-dimensional image of each particle, the diameter of a circle having the same area is calculated as the circle-equivalent diameter. The circularity of each particle is calculated from the projected area of the two-dimensional image of each particle and from the circumferential length of the projected image according to the above equation for calculating the circularity.

In the present invention, in number-based particle size distribution of toner base particles having a circle-equivalent diameter of from 0.6 μm or more to 400 μm or less as measured with the flow type particle image analyzer, toner base particles having diameters from 0.6 μm or more to less than 3 μm may preferably be in a percentage of from 0% by number or more to less than 20% by number, more preferably from 0% by number or more to less than 17% by number, and particularly preferably from 1% by number or more to less than 15% by number. The toner base particles having diameters from 0.6 μm or more to less than 3 μm have a great influence on the developing performance of the toner, in particular, fog characteristics. Such a fine particle toner tends to have excessively high charge and to contribute in surplus to the development with the toner, and is liable to appear as fog on images. However, in the present invention, the proportion of such a fine-particle toner is less so that the fog can be reduced.

In addition, the toner of the present invention has a high average circularity as describe above, and hence the toner tends to create a state in which the toner is more densely packed, where the developing sleeve tends to be more thickly coated with the toner. As a result, the charge quantity is different between the upper layer and the lower layer of the toner layer to cause sleeve negative ghost in which the image density of image areas corresponding to the second and further round of the sleeve comes lower than the image density at the leading end when images with a large area are continuously developed. If ultrafine powder is present in toner base particles in a large quantity on that occasion, the ultrafine powder tends to cause a difference in image density because such powder has a higher charge quantity than other toner base particles, and tends to cause the sleeve negative ghost greatly. In the present invention, the ultrafine powder is in a small quantity, and hence this enables the sleeve negative ghost to be kept from occurring. If the toner base particles having diameters from 0.6 μm or more to less than 3 μm are in a percentage of more than 20% by number, the fog on images may greatly occur and further the sleeve negative ghost may greatly occur.

In the toner base particles of the present invention, toner base particles having a circularity of less than 0.960 may preferably be in a number cumulative value of from 20% or more to less than 70%, preferably from 25% or more to less than 65%, more preferably from 30% or more to less than 65%, and still more preferably from 35% or more to less than 65%. The circularity of toner base particles differs between individual toner base particles. Such difference in circularity brings about a difference in characteristics as toner base particles. Hence, the percentage of toner base particles having appropriate circularities may preferably be in a proper value in order the toner base particles to have higher developing performance.

The toner base particles in the present invention have an appropriate average circularity and at the same time have an appropriate circularity distribution, and hence the toner base particles can have uniform charge distribution and the occurrence of the fog can be reduced. If the toner base particles having the circularity of less than 0.960 are in a number cumulative value of less than 20% by number, the toner may deteriorate during running. If the toner base particles having the circularity of less than 0.960 are in a number cumulative value of 70% by number or more, the fog may greatly occur and the image density may be lowered in a high-temperature and high-humidity environment.

The present invention is also characterized in that the toner base particles have an average surface roughness of from 5.0 nm or more to less than 35.0 nm, preferably from 8.0 nm or more to less than 30.0 nm, and more preferably from 10.0 nm or more to less than 25.0 nm. Inasmuch as the toner base particles have an appropriate average surface roughness, appropriate spaces are produced between toner particles, and the toner can be improved in fluidity, so that better developing performance can be brought about. Especially in the toner base particles having the average circularity that is characteristic of the present invention, the above average surface roughness can provide the toner with superior fluidity. Also, such a feature that the ultrafine particles having diameters of less than 3 μm are present in a small number in the toner base particles of the present invention effectively acts on the improvement of fluidity. More specifically, if such ultrafine particles are present in a large number in the toner base particles, the ultrafine particles may enter the concavities of toner base particle surfaces to reduce the apparent average surface roughness of the toner base particles, so that the spaces between particles lessen to prevent the toner from being provided with favorable fluidity. If the toner base particles have an average surface roughness of less than 5.0 nm, the toner can not be provided with sufficient fluidity to cause fading, resulting in a decrease in image density. If the toner base particles have an average surface roughness of 35.0 nm or more, the spaces between toner base particles come to be so many as to cause toner scatter.

In the present invention, it is preferable that the toner particles have an average surface roughness of from 10.0 nm or more to less than 26.0 nm, and preferably from 12.0 nm or more to less than 24.0 nm.

If the toner particles have an average surface roughness of less than 10.0 nm, the particles of external additives may be embedded in a large number in the concavities of toner base particle surfaces, so that the toner may not readily be provided with sufficient fluidity, tending to cause fading to make it difficult to obtain good images. If on the other hand the toner particles have an average surface roughness of 26.0 nm or more, the toner base particle surfaces may not be uniformly coated with the particles of external additives, tending to result in faulty charging and to cause spots around line images greatly. Thus, the toner particles having the appropriate particle surface roughness and circularity make it easy to obtain the effect of the present invention.

It is also preferable that the toner base particles have the maximum vertical difference of 50 nm or more to less than 250 nm, preferably from 80 nm or more to less than 220 nm, and more preferably from 100 nm or more to less than 200 nm. This enables the toner to be provided with better fluidity. If the toner base particles have the maximum vertical difference of less than 50 nm, it may be difficult to provide the toner with sufficient fluidity, and fading may occur to lower image density. If the toner base particles have the maximum vertical difference of 250 nm or more, the toner scatter may occur.

The toner base particles may also preferably have a surface area of from 1.03 $\mu m^2$ or more to less than 1.33 $\mu m^2$, preferably from 1.05 $\mu m^2$ or more to less than 1.30 $\mu m^2$, and more preferably from 1.07 $m^2$ or more to less than 1.28 $m^2$, in a 1 μm square on the particle surface as measured with a scanning probe microscope. This enables the toner to be provided with better fluidity. If the toner base particles have that surface area of less than 1.03 $\mu m^2$, the toner may have a low fluidity to cause fading to lower image density. If the toner base particles have that surface area of 1.33 $\mu m^2$ or more, the toner scatter (spots around line images) may occur.

In the present invention, the average surface roughness, maximum vertical difference and surface area of the toner base particles and toner particles are measured with a scanning probe microscope. An example of measuring methods is shown below.

Probe station: SPI3800N (manufactured by Seiko Instruments Inc.); measuring unit: SPA400.

Measuring mode: DFM(resonance mode)-shape images.

Cantilever: SI-DF40P.

Resolution: the number of X-data: 256; the number of Y-data: 128.

In the present invention, a surface area in a 1 μm square on the surface of each of the toner base particles and each of the toner particles is measured. The surface area to be measured is an area in a 1 μm square at the middle portion on each of the surfaces of the toner base particles and the toner particles measured with the scanning probe microscope. As the toner base particles and toner particles which are to be measured, toner base particles and toner particles which have particle diameters equal to the weight-average particle diameter (D4) measured by the Coulter counter method are picked out at random, and the toner base particles and toner particles thus picked out are measured. The data obtained by measurement are subjected to secondary correction. Five or more particles of different toner base particles and toner particles are measured, and an average value of the data obtained is calculated to find the average surface roughness, maximum vetical difference and surface area of the toner base particles and toner particles.

In the toner particles in which external additives (inorganic fine particles) have been externally added to the toner base particles, the external additives must be removed from toner particle surfaces when the surface properties of the toner base particles are measured with the scanning probe microscope. As a specific method therefor, the following method is available, for example.

(1) 45 g of the toner is put into a sample bottle, to which 10 ml of methanol is added.

(2) The sample is dispersed for 1 minute by means of an ultrasonic cleaning machine to separate the external additives.

(3) The toner base particles and the external additives are separated by suction filtration (using a 10 μm membrane filter). In the case of a magnetic toner containing a magnetic material, a magnet may be put on the bottom of the sample bottle to fix the toner base particles so that only the supernatant liquid can be separated.

(4) The above steps (2) and (3) are carried out three times in total, and the resultant toner base particles are sufficiently dried at room temperature by means of a vacuum dryer.

The toner base particles from which the external additives have been removed, are observed on a scanning electron microscope. After making sure that the external additives have disappeared, the surfaces of the toner base particles may be observed with the scanning probe microscope. If the external additives have not completely been removed, the steps (2) and (3) are repeated until the external additives are sufficiently removed, and thereafter the surfaces of the toner base particles are observed with the scanning probe microscope.

As another method for removing the external additives in place of the steps (2) and (3), a method is available in which the external additives are dissolved with an alkali. As the alkali, an aqueous sodium hydroxide solution is preferred.

The respective terms are explained below.

Average Surface Roughness (Ra):

Roughness which is three-dimensionally extended so that the center-line average roughness Ra defined in JIS B 0601 can be applied to a face to be measured. It is a value found by averaging absolute values of deviations from the reference face to the specified face, and is expressed by the following equation.

$$R_a = \frac{1}{S_o}\int_{Y_R}^{Y_T}\int_{X_L}^{X_R}|F(X, Y) - Z_o|dX\,dY$$

where;

F(X,Y) represents the face where the whole measurement data stand;

$S_0$ represents the area found assuming that the specified face is ideally flat; and $Z_0$ represents the average value of Z-data (data in the direction vertical to the specified face) in the specified face.

In the present invention, the specified face refers to the area to be measured in a 1 μm square.

Maximum Peak-to-Valley Difference (P-V):

The difference between the maximum value and the minimum value of Z-data in the specified face.

Surface Area (S):

The surface area of the specified face.

Then, as a preferred method for obtaining the toner base particles characteristic of the present invention, a method is available in which toner constituent materials are mixed, thereafter the mixture obtained is kneaded by means of a heat kneading machine, the kneaded product is cooled to solidify, then crushed, followed by pulverization, and thereafter the resultant toner base particles are subjected to surface modification and removal of fine powder simultaneously by means of a surface modifying apparatus.

A process for producing the toner base particles which carries out surface modification by means of a surface modifying appratus is specifically described below with reference to drawings showing a surface modifying apparatus used in the surface modification.

In the present invention, the surface modification of toner base particles is meant to smooth the surfaces of the toner base particles.

Figure 2:
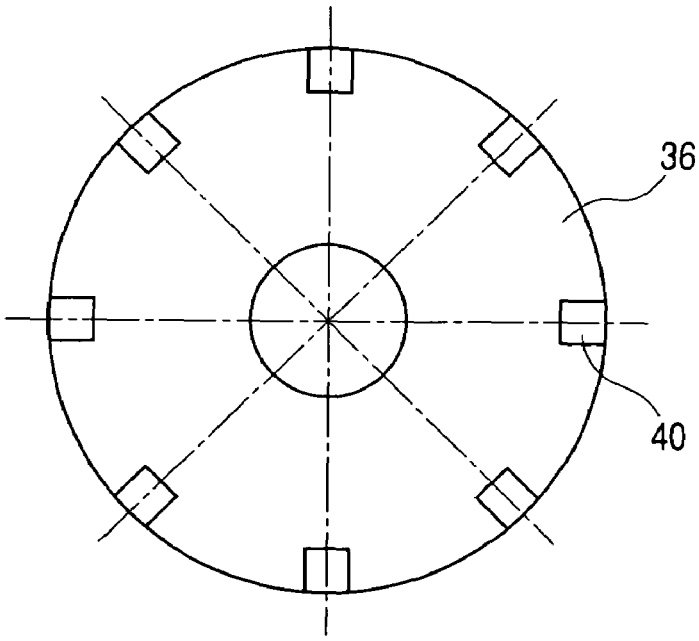
FIG. 2 is a schematic view showing an example of a top plan view of a dispersing rotor shown in FIG. 1.

FIG. 1 illustrates an example of the surface modifying apparatus preferably usable in producing the toner base particles according to the present invention. FIG. 2 illustrates an example of a top plan view of a rotor which rotates at a high speed in the apparatus shown in FIG. 1.

The surface modifying apparatus shown in FIG. 1 is constituted of a casing; a jacket (not shown) through which cooling water or an anti-freeze can be passed; a dispersing rotor (surface modifying means) 36 which is a disklike rotating member rotatable at a high speed, provided in the casing and attached to the center rotational shaft, and having a plurality of rectangular disks or cylindrical pins 40; liners 34 disposed on the outer periphery of the dispersing rotor 36 at intervals kept constant and provided with a large number of grooves on the surfaces (the grooves on the liner surfaces are not required to be provided); a classifying rotor 31 which is a means for classification into a surface-modified material with given particle diameters; a cold air inlet 35 for introducing cold air; a material feed opening 33 for introducing the material to be treated; a discharge valve 38 provided so that it can be opened and closed and surface modification time can freely be controlled; and a powder discharge opening 37 for discharging the powder having been treated. The surface modifying apparatus further has a cylindrical guide ring 39 which is a means by which the space between the classifying means classifying rotor 31 and the surface modifying means dispersing rotor 36 is partitioned into a first space 41 through which the surface-modified material passes before it is introduced into the classifying means and a second space 42 through which the particles from which fine powder has been removed by classification by the classifying means are introduced into the surface modifying means. A gap formed between the dispersing rotor 36 and the liners 34 is a surface modification zone, and the classifying rotor 31 and its surrounding area is a classification zone.

The classifying rotor 31 may be of a vertical type as shown in FIG. 1, or of a lateral type. There may be only one classifying rotor 31 as shown in FIG. 1, or two or more.

In the surface modifying apparatus constituted as described above, material toner base particles are introduced through the material feed opening 33 in the state the discharge valve 38 is closed, whereupon the material toner base particles introduced are first sucked by a blower (not shown), and then classified by the classifying rotor 31. In that classification, the classified fine powder of particles smaller than the desired particle size is continuously discharged and removed out of the apparatus, and coarse powder of particles larger than the desired particle size is carried on the circulating flow generated by the dispersing rotor 36, along the inner periphery of the guide ring 39 (in the second space 42) by the aid of centrifugal force, and is guided to the surface modification zone. The toner base particles guided to the surface modification zone undergoes mechanical impact force between the dispersing rotor 36 and the liners 34, and the toner base particles are treated by surface modification. The toner base particles having been subjected to surface modification are carried on the cold air passing through the interior of the apparatus, and are guided to the classification zone along the outer periphery of the guide ring 39 (in the first space 41), where fine powder is discharged out of the apparatus by the action of the classifying rotor 31, and coarse powder, carried on the circulating flow, is again returned to the surface modification zone, and the toner base particles undergo surface modification action repeatedly. After a certain time passes, the discharge valve 38 is opened to collect the surface-modified particles through the discharge opening 37.

In the production of the toner base particles in the present invention, the fine powder component may preferably be removed simultaneously with the surface modification of toner base particles in the step of the surface modification of toner base particles. Thus, ultrafine particles present in the toner base particles do not stick, or are kept from sticking, to the toner base particle surfaces, and toner base particles having the desired circularity, average surface roughness and ultrafine-particle content can effectively be obtained. If the fine powder can not be removed simultaneously with the surface modification, the ultrafine particles may come to be present in a large quantity in the toner base particles after the surface modification, and besides, in the step of the surface modification of toner base particles, the ultrafine particles may stick to the surfaces of toner base particles having proper particle diameters, because of mechanical and thermal influence. As a result, protrusions due to the fine-particle component having stuck are produced on the surfaces of the toner base particles, making it difficult to obtain the toner base particles having the desired circularity and average surface roughness.

In the present invention, it is meant by "the fine powder is removed simultaneously with the surface modification" that the surface modification of toner base particles and the removal of fine powder are repeatedly carried out. It may be done using an apparatus like the above, effecting the respective steps in a single apparatus. Alternatively, the surface modification of toner base particles and the removal of fine powder may be carried out using different apparatus, and the respective steps may repeatedly be carried out.

As a result of studies made by the present inventors, the surface modification time in the surface modifying apparatus (i.e., cycle time) may preferably be from 5 seconds to 180 seconds, and more preferably from 15 seconds to 120 seconds. If the surface modification time is less than 5 seconds, the surface modification time may be too short to sufficiently carry out the surface modification of toner base particles and to suffciently carry out the removal of fine powder from the toner base particles. If on the other hand the surface modification time is more than 180 seconds, the surface modification time may be so long as to cause in-machine melt adhesion due to the heat generated at the time of surface modification and cause a lowering in processing ability.

In the process for producing the toner base particles in the present invention, it is further preferable that cold air temperature T1 at which the cold air is introduced into the surface modifying apparatus is controlled to 5° C. or less. Inasmuch as the cold air temperature T1 at which the cold air is introduced into the surface modifying apparatus is controlled to 5° C. or less, more preferably 0° C. or less, still more preferably −5° C. or less, particularly preferably −10° C. or less, and most preferably −15° C. or less, the in-machine melt adhesion due to the heat generated at the time of surface modification can be prevented. If the cold air temperature T1 at which the cold air is introduced into the surface modifying apparatus is more than 5° C., the in-machine melt adhesion due to the heat generated at the time of surface modification may occur.

The cold air introduced into the surface modifying apparatus may preferably be dehumidified air in view of the prevention of moisture condensation inside the apparatus. As a dehumidifier, any known apparatus may be used. As air feed dew point temperature, it may preferably be −15° C. or less, and more preferably be −20° C. or less.

In the process for producing the toner base particles in the present invention, it is further preferable that the surface modifying apparatus is provided with a jacket for in-machine cooling and the surface modification is carried out with a refrigerant (preferably cooling water, and more preferably an anti-freeze such as ethylene glycol) running through the jacket. The in-machine cooling by means of the jacket can prevent in-machine melt adhesion due to the heat generated at the time of surface modification.

The refrigerant running through the jacket of the surface modifying apparatus may preferably be controlled to a temperature of 5° C. or less. Inasmuch as the refrigerant running through the jacket of the surface modifying apparatus is controlled to a temperature of 5° C. or less, which may preferably be 0° C. or less, and more preferably be −5° C., the in-machine melt adhesion due to the heat generated at the time of surface modification can be prevented. If the refrigerant running through the jacket is more than 5° C., the in-machine melt adhesion due to the heat generated at the time of surface modification may occur.

In the process for producing the toner base particles of the present invention, it is further preferable that temperature T2 at the rear of the classifying rotor in the surface modifying apparatus is controlled to 60° C. or less. Inasmuch as the temperature T2 at the rear of the classifying rotor in the surface modifying apparatus is controlled to 60° C. or less, which may preferably be 50° C. or less, the in-machine melt adhesion due to the heat generated at the time of surface modification can be prevented. If the temperature T2 at the rear of the classifying rotor in the surface modifying apparatus is more than 60° C., the in-machine melt adhesion due to the heat generated at the time of surface modification may occur because the surface modification zone is affected by temperature higher than that temperature.

In the process for producing the toner base particles of the present invention, it is further preferable that the minimum gap between the dispersing rotor and the liners in the surface modifying apparatus is set to be from 0.5 mm to 15.0 mm, and more preferably from 1.0 mm to 10.0 mm. It is also preferable that the rotational peripheral speed of the dispersing rotor is set to be from 75 m/sec to 200 m/sec, and more preferably from 85 m/sec to 180 m/sec. It is further preferable that the minimum opening between the tops of the rectangular disks or cylindrical pins provided on the top surface of the the dispersing rotor and the bottom of the cylindrical guide ring in the surface modifying apparatus is set to be from 2.0 mm to 50.0 mm, and more preferably from 5.0 mm to 45.0 mm.

In the present invention, pulverizing faces of the dispersing rotor and liners in the surface modifying apparatus may be those having been subjected to wear-resistant treatment. This is preferable in view of productivity of the toner base particles. There are no limitations at all on how to carry out the wear-resistant treatment. There are also no limitations at all also on the blade shapes of the dispersing rotor and liners in the surface modifying apparatus.

As the process for producing the toner base particles in the present invention, it is preferable that material toner base particles beforehand made into fine particles with diameters approximate to the desired particle diameter are treated using an air classifier to remove fine powder and coarse powder to a certain extent, and thereafter the surface modification of toner base particles and the removal of the ultrafine powder component are carried out using the surface modifying apparatus. Inasmuch as the fine powder is beforehand removed, the dispersion of toner base particles in the surface modifying apparatus is improved. In particular, the fine powder component in toner base particles has a large specific surface area, and has a relatively high charge quantity compared with other large toner base particles. Hence, it can not easily be separated from other toner base particles, and the ultrafine powder component is not properly classified by the classifying rotor in some cases. However, by beforehand removing the fine powder component in toner base particles, individual toner base particles can be readily dispersed in the surface modifying apparatus, and the ultrafine powder component is properly classified by the classifying rotor, so that the toner base particles having the desired particle size distribution can be obtained.

In the toner base particles from which the fine powder has been removed by an air classifier, the cumulative value of number-average distribution of toner base particles having diameters of less than 4 μm may be from 10% or more to less than 50%, preferably from 15% or more to less than 45%, and more preferably from 15% or more to less than 40%, in particle size distribution as measured by the Coulter Counter method. Thus, the surface modifying apparatus in the present invention can effectively remove the ultrafine powder component. The air classifier used in the present invention may include Elbow Jet (manufactured by Nittetsu Mining Co., Ltd.) and so forth.

Further, in the present invention, the circularity of the toner base particles and the percentage of particles having diameters of from 0.6 μm or more to less than 3 μm in the toner base particles can be controlled to more proper values by controlling the number of revolutions of the dispersing rotor and classifying rotor in the surface modifying apparatus.

In the present invention, when the wettability of the toner base particles to a methanol/water mixed solvent is measured at transmittance of light of 780 nm in wavelength, the methanol concentration at the time the transmittance is 80% and the methanol concentration at the time the transmittance is 50% may be within the range of from 35 to 75% by volume, preferably from 40 to 70% by volume, more preferably from 45 to 65% by volume, and still more preferably from 45 to 60% by volume. Toner base particles having such methanol concentration-transmittance characteristics can be obtained using the surface modifying apparatus characteristic of the present invention and setting surface modification conditions to appropriate conditions. Thus, raw materials can stand uncovered to toner base particle surfaces in an adequate proportion, and appropriate and sharp chargeability can be brought to the toner base particles. Also, the toner base particles of the present invention have the average circularity of from 0.935 or more to less than 0.970, and can have superior fluidity when made into the toner. The toner having such good fluidity and sharp charge quantity distribution can have uniform and high chargeability in the toner container, and good and stable image density can be attained even when used for a long period of time. The toner acts effectively, especially in an environment where the toner tends to agglomerate to have a poor fluidity or to have a low charge quantity, as in a high-temperature and high-humidity environment.

If the methanol concentration at the time the transmittance is 80% and the methanol concentration at the time the transmittance is 50% are less than 35% by volume, the toner may have insufficient chargeability to make image density inferior. If on the other hand the methanol concentration at the time the transmittance is 80% and the methanol concentration at the time the transmittance is 50% are more than 75% by volume, the toner comes so highly agglomarative that no sufficient fluidity may be obtained to result in insuffcient developing performance in a high-temperature and high-humidty environment.

The difference between the methanol concentration at the time the transmittance is 80% and the methanol concentration at the time the transmittance is 50% may also be 10% or less, preferably 7% or less, and more preferably 5% or less, where the toner can be provided with better developing performance. If the difference in the concentration is more than 10%, the toner may have a non-uniform particle surface state, and a toner improperly atributing to the development may increase and tends to cause fog greatly or cause blotches because of faulty charging.

Figure 3:
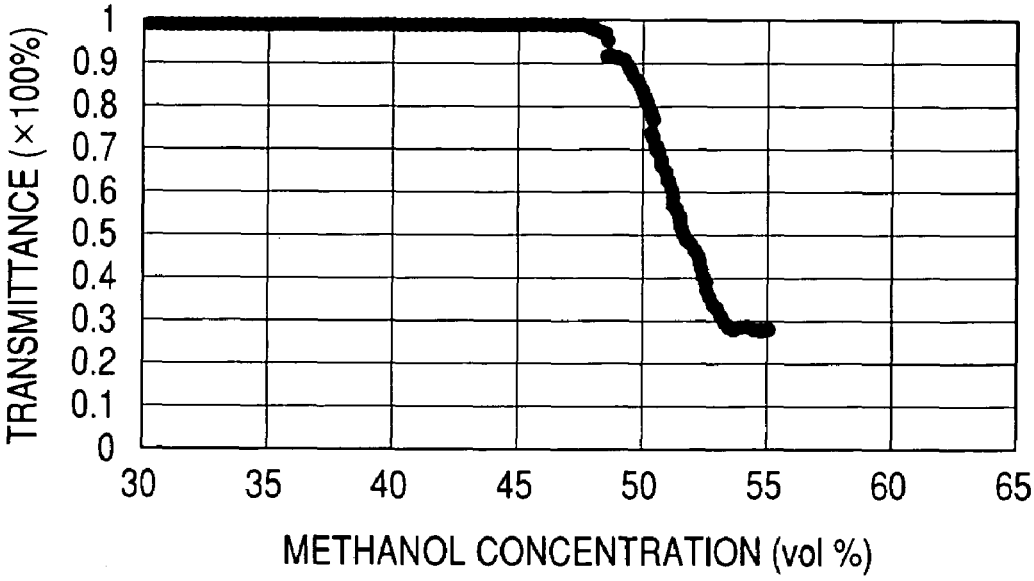
FIG. 3 is a graph showing transmittance involved with Toner Base Particles 1 in Example 1 of the present invention, with respect to methanol concentration.

In the present invention, the wettability of the toner base particles, i.e., hydrophobic properties, is measured using a methanol drop transmittance curve. Stated specifically, e.g., a powder wettability tester WET-100P, manufactured by Rhesca Company, Limited, may be used as a measuring instrument therefor, and a methanol drop transmittance curve is used which is prepared by the following conditions and procedures. First, 70 ml of a water-containing methanol solution composed of 30 to 50% by volume of methanol and 50 to 70% by volume of water is put into a container. To this solution, 0.1 g of specimen toner base particles are precisely weighed and added to prepare a sample fluid used for the measurement of hydrophobic properties of the toner base particles. Next, to this sample fluid, methanol is continuously added at a dropping rate of 1.3 ml/min., during which the transmittance is measured using light of 780 nm in wavelength to prepare a methanol drop transmittance curve as shown in FIG. 3. Here, the reason why methanol is used as a titration solvent is that the elution of a dye, a pigment, a charge control agent and so forth which are contained in the toner base particles has less influence and the surface state of the toner base particles can more accurately be observed.

In the technique of modifying the shapes and surface properties of particles in this way, in addition to the use of the surface modifying apparatus, it is important to improve toner materials, in particular, the binder resin, because the modification performance varies with the properties of the binder resin.

The binder resin used in the present invention is characterized by containing at least a vinyl resin having as partial structure a linkage formed by the reaction of a carboxyl group with an epoxy group. Such a binder resin in combination with the above surface modification of toner particles can provide the toner with higher charging performance, and stable images can be obtained over a long period of time without lowering image density. This is because residual carboxyl groups having negative polarity in the binder resin or ester moieties formed by the reaction of carboxyl groups with epoxy groups interact with the resin itself or with a negative charge control agent at the toner base particle surfaces to improve the state of dispersion of the resin and negative charge control agent at the toner base particle surfaces.

In addition, due to the improvement in the dispersibility of the resin and charge control agent as described above, the toner can be uniformly and stably charged, any excess charge-up can be prevented from occurring especially in a low-temperature and low-humidity environment, and the occurrence of sleeve negative ghost can be greatly reduced.

Usually, toner base particles having a cross-linked resin tend to cause coarse powder in the course of their production, and to cause faulty images due to sleeve coat non-uniformity. However, the step of surface modification carried out as described above lessens the coarse powder, and enables good images to be obtained even in a high-speed developing appratus.

Moreover, the surface composition of the toner base particles may change at the time of such surface modification to make it unable to exhibit the intended performance. However, in the present invention, the binder resin is provided with an appropriate viscosity more preferably by controlling the molecular weight distribution of the binder resin, so that the toner base particles can be treated to have the desired circularity without any great change in their surface composition, and the above effect can be obtained with ease.

Stated specifically, the toner base particles and toner of the present invention may preferably have, in molecular weight distribution of tetrahydrofuran (THF)-soluble matter measured by gel permeation chromatography (GPC), a number-average molecular weight of from 1,000 to 40,000, more preferably from 3,000 to 20,000, and particularly preferably from 5,500 to 10,000. They may also preferably have a weight-average molecular weight of from 10,000 to 1,000,000, more preferably from 50,000 to 500,000, and particularly preferably from 70,000 to 200,000. It is preferred that the toner of the present invention show the above molecular weight distribution, in order to appropriately balance the fixing performance, the anti-offset properties and anti-blocking properties. This is also preferable in order to attain the desired circularity and ultrafine-particle content without applying any excess load to the surface modifying apparatus in carrying out the step of the surface modification of toner base particles. If the toner has a number-average molecular weight of less than 1,000 or a weight-average molecular weight of less than 10,000, the toner may have poor anti-blocking properties. Also, the circularity is higher than needed, and the toner is fed onto the developing sleeve in excess to non-uniformly coat the sleeve, consequently tending to cause blotches. If the toner has a number-average molecular weight of more than 40,000 or a weight-average molecular weight of more than 1,000,000, it is difficult for the toner to be sufficiently improved in fixing performance. Further, the desired circularity may be not obtained, resulting in large toner consumption.

The toner base particles and toner of the present invention may preferably have, in molecular weight distribution of THF-soluble as matter measured by GPC, a main peak in the region of molecular weight of from 4,000 to 30,000, more preferably from 5,000 to 25,000, and particularly preferably from 10,000 to 18,000. It is preferable for the toner of the present invention to have above main peak, in order to improve its fixing performance, anti-offset properties and anti-blocking properties. If the toner has a main peak in the region of molecular weight of less than 4,000, the toner tends to have poor anti-blocking properties. If it has a main peak in the region of molecular weight of more than 30,000, the good fixing performance of the toner is liable to be lowered. Further, in the case of the toner base particles, they may non-uniformly be pulverized to contain the ultrafine powder in a large quantity to tend to cause fog.

The toner of the present invention has, in molecular weight distribution of THF-soluble matter as measured by GPC, a main peak in the region of molecular weight of from 4,000 to 30,000 and at lest one sub-peak or shoulder in the region of molecular weight of from 50,000 to 20,000,000. As to the latter molecular weight distribution, it is preferable that the area of the region of molecular weight of 50,000 or more is in a proportion of from 1% to 50% to the area of the whole region and the area of the region of molecular weight of 3,000,000 or more is in a proportion of from 0% to 20% to the area of the whole region.

It is preferable for the toner of the present invention to have the above peak profile, in order to improve its fixing performance, anti-offset properties and anti-blocking properties. In the toner of the present invention, the feature that a main peak is in the region of molecular weight of from 4,000 to 30,000 is effective for the achievement of good fixing performance and anti-blocking properties, and the feature that at least one sub-peak or shoulder is in the region of molecular weight of from 50,000 to 20,000,000 is effective in achieving good anti-offset properties.

In the toner of the present invention, where two or more molecular weight ranges wherein a peak is present in each range are defined, it is preferred that the peak present in the region of molecular weight of from 4,000 to 30,000 may be the maximum peak (main peak), from the viewpoint of the improvement in fixing performance.

The sub-peak or shoulder present in the region of molecular weight of from 50,000 to 20,000,000 may preferably be a component formed by cross-linking of the binder resin. This is effective in improving anti-offset properties. Also, where the toner has a peak in the region of molecular weight of from 50,000 to 3,000,000, it improves the dispersibility of the component of molecular weight of from 4,000 to 30,000 and a component of molecular weight of from 3,000,000 to 20,000,000, which are greatly different from each other in melt viscosity, and the dispersibility of THF-insoluble matter into the toner, and is effective in improving developing performance and fixing performance.

The toner of the present invention may contain THF-insoluble matter in an amount of from 0.1 to 60% by weight based on the weight of the binder resin. This is preferable in order to improve anti-offset properties.

The THF-insoluble matter is contained more preferably in an amount of from 5 to 60% by weight, still more preferably from 7 to 55% by weight, further more preferably from 9 to 50% by weight, and most preferably from 10 to 45% by weight. The feature that the content of the THF-insoluble matter is within the above range is preferable in order to improve fixing performance and anti-offset properties in a well-balanced state, and is preferable in order to bring out especially good releasability.

If the THF-insoluble matter is contained in an amount of less than 5% by weight, the above anti-offset properties may come poor. If contained in an amount of more than 60% by weight, not only the fixing performance may be lowered, but also the toner chargeability tends to come non-uniform. Also, coarse particles tend to be formed in producing the toner base particles and to cause faulty coating of toner on the developing sleeve.

In the toner of the present invention, the tetrahydrofuran (THF)-soluble component of the toner may preferably have an acid value of less than 50 mg·KOH/g, more preferably from 1.0 to 40 mg·KOH/g, and still more preferably from 1.0 to 35 mg·KOH/g. This is preferable in order to achieve better developing performance and prevent the developing sleeve and fixing rollers from being contaminated.

The toner of the present invention may preferably have a glass transition temperature (Tg) of from 40° C. to 70° C. If it has the Tg of less than 40° C., the toner tends to have poor anti-blocking properties. If having the Tg of more than 70° C., the toner tends to have a low fixing performance.

In the toner of the present invention, the vinyl resin having as partial structure a linkage formed by the reaction of a carboxyl group with an epoxy group is contained as the binder resin. Further, in the toner of the present invention, the binder resin may preferably contain a vinyl resin component having a carboxyl group. In this case, the binder resin has as partial structure the linkage formed by the reaction of a carboxyl group with an epoxy group, and the vinyl resin component having a carboxyl group has the acid value.

The "vinyl resin having as partial structure a linkage formed by the reaction of a carboxyl group with an epoxy group" may preferably be one in which the carboxyl group of a vinyl resin component having a carboxyl group and the epoxy group of a vinyl resin component having an epoxy group are bonded, or the carboxyl group and epoxy group in a vinyl resin component having a carboxyl group and an epoxy group are bonded. Preferably, it is favorable to react the carboxyl group of a vinyl resin component having a carboxyl group with the epoxy group of a vinyl resin component having an epoxy group.

The "linkage formed by the reaction of a carboxyl group with an epoxy group" is the following when, e.g., a resin component having a glycidyl group as the epoxy group is used:

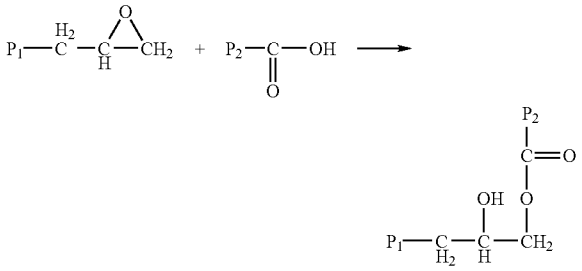

wherein $P_1$ represents a polymer chain of the vinyl resin component having an epoxy group, and $P_2$ represents a polymer chain of the vinyl resin component having a carboxyl group.

As a monomer having carboxyl group(s) usable for obtaining the "vinyl resin having a carboxyl group," "vinyl resin component having a carboxyl group," "vinyl resin having as partial structure a linkage formed by the reaction of a carboxyl group with an epoxy group" or "vinyl resin component having as partial structure a linkage formed by the reaction of a carboxyl group with an epoxy group" according to the present invention, it may include, e.g., unsaturated monocarboxylic acids such as acrylic acid, methacrylic acid, α-ethylacrylic acid, crotonic acid, cinnamic acid, vinylacetic acid, isocrotonic acid, tiglic acid and angelic acid, and α- or β-alkyl derivatives of these; unsaturated dicarboxylic acids such as fumaric acid, maleic acid, citraconic acid, alkenylsuccinic acids, itaconic acid, mesaconic acid, dimethylmaleic acid and dimethylfumaric acid; and monoester derivatives, anhydrides or α- or β-alkyl derivatives of the unsaturated dicarboxylic acids. The above monomer having carboxyl group(s) may be used alone or in the form of a mixture, and may also be used after it has been copolymerized with other vinyl monomer by a known polymerization method.

The "vinyl resin having a carboxyl group" which may be used when obtaining the "vinyl resin having as partial structure a linkage formed by the reaction of a carboxyl group with an epoxy group" according to the present invention may preferably have an acid value of from 1.0 to 60 mg·KOH/g, more preferably from 1.0 to 50 mg·KOH/g, and still more preferably from 2.0 to 40 mg·KOH/g. If it has an acid value of less than 1.0 mg·KOH/g, the sites at which the carboxyl group and the epoxy group such as a glycidyl group undergo cross-linking reaction are so few that the cross-linking structure may not sufficiently be formed, to make it difficult to sufficiently achieve the improvement of running (extensive operation) performance of the toner. In such a case, a vinyl resin having a glycidyl group with a high epoxy value may be used to enhance crosslink density to a certain extent. However, residual epoxy groups may influence developing performance or make it difficult to control the cross-linked structure. If the acid value is more than 60 mg·KOH/g, the toner may have so strong moisture absorption as to result in a decrease in image density and an increase in fog.

In the "vinyl resin having a carboxyl group" which may be used when obtaining the "vinyl resin having as partial structure a linkage formed by the reaction of a carboxyl group with an epoxy group" according to the present invention, the number-average molecular weight may preferably be from 10,000 to 40,000 in order to achieve good fixing performance and developing performance, and the weight-average molecular weight may preferably be from 10,000 to 10,000,000 in order to achieve good anti-offset properties, anti-blocking properties and running performance.

The "vinyl resin having a carboxyl group" which may be used when obtaining the "vinyl resin having as partial structure a linkage formed by the reaction of a carboxyl group with an epoxy group" according to the present invention may preferably contain a low-molecular weight component having a peak in the region of low-molecular weight and a high-molecular weight component having a peak in the region of high-molecular weight. The low-molecular weight component may preferably have a peak molecular weight of from 4,000 to 30,000, and more preferably from 5,000 to 25,000, in order to achieve good fixing performance. The high-molecular weight component may preferably have a peak molecular weight of from 100,000 to 1,000,000, and more preferably from 100,000 to 500,000, in order to achieve good anti-offset properties, anti-blocking properties and running performance.

In the "vinyl resin having a carboxyl group" which may be used when obtaining the "vinyl resin having as partial structure a linkage formed by the reaction of a carboxyl group with an epoxy group," the low-molecular weight component and the high-molecular weight component may be used in a weight ratio of low-molecular weight component:high-molecular weight component of from 95:5 to 50:50, and preferably from 90:10 to 55:45. This is preferable in view of fixing performance, and dispersibility of other additives such as wax.

Synthesis methods for obtaining the high-molecular weight component of the "vinyl resin having a carboxyl group" may include bulk polymerization, solution polymerization, emulsion polymerization and suspension polymerization.

Of these, the emulsion polymerization is a method in which a monomer almost insoluble in water is dispersed with an emulsifying agent in an aqueous phase in the form of small particles to carry out polymerization using a water-soluble polymerization initiator. With this method, the rate of termination reaction is small because the phase in which the polymerization is carried out (an oily phase formed of polymers and monomers) is separated from the aqueous phase, so that a product with a high degree of polymerization can be obtained. Moreover, the reaction heat can be easily controlled, the polymerization process is relatively simple and the polymerization product is in the form of fine particles, and so, the colorant, charge control agent and other additives can be mixed with ease. Thus, this is advantageous as a process for producing binder resins for toners.

However, the polymer tends to become impure because of the emulsifying agent added, and a process such as salting-out is required to take out the polymer. In order to avoid such inconvenience, suspension polymerization is advantageous.

In the suspension polymerization, the reaction may preferably be carried out using the polymerizable monomer in an amount of not more than 100 parts by weight, and preferably from 10 to 90 parts by weight, based on 100 parts by weight of an aqueous medium. Usable dispersants include polyvinyl alcohol, partially saponified polyvinyl alcohol, and calcium phosphate, any of which may commonly be used in an amount of from 0.05 to 1 part by weight based on 100 parts by weight of the aqueous medium. Polymerization temperature from 50° C. to 95° C. is suitable, and may appropriately be selected depending on the initiator used and the intended polymer.

In obtaining the high-molecular weight component of the "vinyl resin having a carboxyl group," a polyfunctional polymerization initiator as exemplified below may be used as a polymerization initiator in order to achieve the object of the present invention.

As specific examples of the polyfunctional polymerization initiator, having a polyfunctional structure, it may include polyfunctional polymerization initiators having in one molecule two or more functional groups such as peroxide groups, having a polymerization initiating function, as exemplified by 1,1-di-t-butylperoxy-3,3,5-trimethylcyclohexane, 1,3-bis(t-butylperoxyisopropyl)benzene, 2,5-dimethyl-2,5-(t-butylperoxy)hexane, 2,5-dimethyl-2,5-di-(t-butylperoxy) hexane, tris-(t-butylperoxy)triazine, 1,1-di-t-butylperoxycyclohexane, 2,2-di-t-butylperoxybutane, 4,4-di-t-butylperoxyvaleric acid-n-butyl ester, di-t-butyl peroxyhexahydroterephthalate, di-t-butyl peroxyazelate, di-t-butyl peroxytrimethyladipate, 2,2-bis(4,4-di-t-butylperoxycyclohexyl)propane, 2,2-di-t-butylperoxyoctane, and various polymer oxides; and polyfunctional polymerization initiators having in one molecule both a functional group such as a peroxide group, having a polymerization initiating function, and a polymerizable unsaturated group, as exemplified by diallyl peroxydicarbonate, t-butyl peroxymaleate, t-butyl peroxyallylcarbonate, and t-butyl peroxyisopropylfumarate.

Of these, more preferred ones are 1,1-di-t-butylperoxy-3,3,5-trimethylcyclohexane, 1,1-di-t-butylperoxycyclohexane, di-t-butyl peroxyhexahydroterephthalate, di-t-butyl peroxyazelate, 2,2-bis(4,4-di-t-butylperoxycyclohexyl) propane, and t-butyl peroxyallylcarbonate.

In order to satisfy various performances required as binder resins, any of these polyfunctional polymerization initiators may preferably be used in combination with a monofunctional polymerization initiator. In particular, in regard to decomposition temperature necessary for attaining the half-life of 10 hours, the polyfunctional polymerization initiator may preferably be used in combination with a monofunctional polymerization initiator having a decomposition temperature lower than the decomposition temperature of the polyfunctional polymerization initiator.

Such a monofunctional polymerization initiator may specifically include organic peroxides such as benzoyl peroxide, 1,1-di(t-butylperoxy)-3,3,5-trimethylcyclohexane, n-butyl-4,4-di(t-butylperoxy)valerate, dicumyl peroxide, 2,2-bis(t-butylperoxydiisopropyl)benzene, t-butylperoxycumene, and di-t-butyl peroxide; and azo or diazo compounds such as azobisisobutylonitrile and diazoaminoazobenzene.

Any of these monofunctional polymerization initiators may be added in the monomer along with the polyfunctional polymerization initiator. In order to keep the efficiency of the polyfunctional polymerization initiator proper, the monofunctional polymerization initiator may preferably be added after the half-life period of the polyfunctional polymerization initiator has passed in the polymerization step.

Any of these polymerization initiators may preferably be added in an amount of 0.01 to 10 parts by weight based on 100 parts by weight of the polymerizable monomer, in view of efficiency.

As methods for synthesizing the low-molecular-weight resin component of the "vinyl resin having a carboxyl group" used when obtaining the "vinyl resin having as partial structure a linkage formed by the reaction of a carboxyl group with an epoxy group," known methods may be used. In bulk polymerization, polymers with a low-molecular weight can be obtained by polymerizing the monomer at a high temperature and accelerating the rate of termination reaction, but there is a problem in that the reaction is difficult to control. In this regard, with solution polymerization, low-molecular weight resin components can be obtained with ease under moderate conditions, utilizing the difference of chain transfer of radicals that is caused by a solvent, and controlling the quantity of initiators and the reaction temperature. Thus, this method is preferred in order to obtain the low-molecular weight resin component in the vinyl resin having a carboxyl group.

As the solvent used in the solution polymerization, xylene, toluene, cumene, cellosolve acetate, isopropyl alcohol or benzene may be used. Where styrene monomers are used as polymerizable monomers, xylene, toluene or cumene is preferred. The solvent may appropriately be selected depending on the monomer to be polymerized or the polymer to be obtained. As to reaction temperature, which may differ depending on the solvent and polymerization initiator to be used and the polymer to be produced, the reaction may be carried out usually at 70° C. to 230° C. In the solution polymerization, it may preferably be carried out using the polymerizable monomer in an amount of from 30 to 400 parts by weight based on 100 parts by weight of the solvent. It is also preferable to further mix other polymer in the solution when the polymerization is terminated, where several kinds of polymers may be mixed.

The "vinyl resin having an epoxy group" which may be used when obtaining the "vinyl resin having as partial structure a linkage formed by the reaction of a carboxyl group with an epoxy group" is described below. The epoxy group referred to in the present invention means a functional group in which an oxygen atom is bonded with different carbon atoms in the same molecule, and has a cyclic ether structure.

As a monomer having an epoxy group that is usable in the present invention, it may include the following: glycidyl acrylate, glycidyl methacrylate, β-methylglycidyl acrylate, β-methylglycidyl methacrylate, allyl glycidyl ether and allyl β-methylglycidyl ether. A glycidyl monomer represented by the general formula (1) below may also preferably be used.

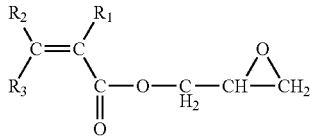

(1)

In the general formula (1), $R_1$, $R_2$ and $R_3$ may be the same or different and each represent a hydrogen atom, or a functional group selected from the group consisting of an alkyl group, an aryl group, an aralkyl group, a carboxyl group and an alkoxycarbonyl group.

Such a monomer having an epoxy group may be polymerized alone or in a mixture of a plurality of types, or may be copolymerized with other vinyl monomer by a known polymerization method to obtain the vinyl resin having an epoxy group.

The "vinyl resin having an epoxy group" used when the binder resin according to the present invention is obtained may preferably have a weight-average molecular weight (Mw) of from 2,000 to 100,000, more preferably form 2,000 to 50,000, and still more preferably from 3,000 to 40,000. If it has the Mw of less than 2,000, the cross-linked structure in the binder resin is apt to become imperfect, and molecules are liable to be cut in the kneading step, tending to result in a low running performance. If it has the Mw of more than 100,000, the fixing performance tends to be lowered.

It may also preferably have an epoxy value of from 0.05 to 5.0 eq/kg, and more preferably from 0.05 to 2.0 eq/kg. If it has an epoxy value of less than 0.05 eq/kg, the cross-linking reaction may proceed with difficulty, and the high-molecular-weight resin component or THF-insoluble matter may be formed in a small quantity so that the toner has low anti-offset properties and toughness. If it has an epoxy value of more than 5.0 eq/kg, the cross-linking reaction may proceed with ease, but on the other hand a large number of molecules may be cut in the kneading step to halve the effect attributable to anti-offset properties.

The "vinyl resin having an epoxy group" according to the present invention may preferably be used in a mixing proportion that the epoxy group is in an equivalent weight of from 0.01 to 10.0, and more preferably in an equivalent weight of from 0.03 to 5.0, based on 1 equivalent weight of carboxyl groups in the "vinyl resin having a carboxyl group" and a "vinyl resin having a carboxyl group contained in others" which are used when the "vinyl resin having as partial structure a linkage formed by the reaction of a carboxyl group with an epoxy group" is obtained. If the epoxy groups are less than 0.01 equivalent weight, the cross-linking points may be so few in the binder resin that the effect attributable to cross-linking reaction, such as anti-offset properties, may be difficult to bring about. If on the other hand it is more than 10.0 equivalent weight, the cross-linking reaction may take place with ease, but on the other hand a low dispersibility or a low pulverizability may result because of, e.g., the formation of excess THF-insoluble matter, tending to cause a lowering of stability of development.

The "vinyl resin having an epoxy group" may also preferably be used in an equivalent weight of from 0.03 to less than 1, and particularly preferably in an equivalent weight of from 0.03 to 0.5, based on 1 equivalent weight of carboxyl groups. Where each vinyl resin is used in an equivalent weight of less than 1, the vinyl resin having a carboxyl group can remain in the state the cross-linking with the epoxy group is not formed, and hence the acid value desired for the binder resin and toner can be attained with ease.

Where the vinyl resin having a carboxyl group and an epoxy group is used when the binder resin according to the present invention is obtained, it may preferably have a number-average molecular weight of from 1,000 to 40,000 in order to achieve good fixing performance. It may also preferably have a weight-average molecular weight of from 10,000 to 10,000,000 in order to achieve good anti-offset properties and anti-blocking properties.

The vinyl resin having a carboxyl group and an epoxy group may be obtained by mixing a monomer having a carboxyl group and a monomer having an epoxy group, and copolymerizing the mixture with another vinyl monomer by a known polymerization method.

In the present invention, as a means for obtaining the "vinyl resin having as partial structure a linkage formed by the reaction of a carboxyl group with an epoxy group," (1) the vinyl resin having a carboxyl group and the vinyl resin having an epoxy group may be mixed in the state of a solution, followed by heating in a reaction vessel to cause the cross-linking reaction to take place, or (2) the vinyl resin having a carboxyl group and the vinyl resin having an epoxy group may each be taken out of a reaction vessel, and may be dry-blended by means of a mixing machine such as Henschel mixer, followed by heat melt-kneading by means of a twin extruder or the like to cause the reaction of a carboxyl group with an epoxy group to take place to effect cross-linking. Also when the vinyl resin having a carboxyl and an epoxy group is used, heat melt-kneading may similarly be carried out by means of a kneading machine such as a twin extruder to react the carboxyl group and the epoxy group with each other.

In the present invention, the "vinyl resin having as partial structure a linkage formed by the reaction of a carboxyl group with an epoxy group" may preferably contain 0.1 to 60% by weight of THF-insoluble matter. In the case where the THF-insoluble matter is within this range, the resin itself can have an appropriate melt viscosity in the step of kneading in the production process, and hence uniform dispersion of materials can be achieved. If the THF-insoluble matter is more than 60% by weight, the resin itself may have so high a melt viscosity as to lower the dispersibility of materials.

The vinyl monomer to be copolymerized with the monomer having a carboxyl group and the monomer having an epoxy group may include the following: e.g., styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrenee, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylene unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; a-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, 1-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide. Any of these vinyl monomers may be used alone or in a mixture of two or more monomers.

Of these, monomers may preferably be used in a combination that gives a styrene copolymer and a styrene-acrylic copolymer. In this case, in view of fixing performance and mixing properties, it is preferred that at least 65% by weight of a styrene copolymer component or a styrene-acrylic copolymer component is contained.

The binder resin according to the present invention contains the vinyl resin having a carboxyl group. Inasmuch as it contains the vinyl resin having a carboxyl group, the binder resin according to the present invention can have an acid value. Since the resin having a carboxyl group is a vinyl resin, a good compatibility with the "vinyl resin having as partial structure a linkage formed by the reaction of a carboxyl group with an epoxy group" can be achieved. As the "vinyl resin having a carboxyl group" incorporated with the binder resin, the same resin as the vinyl resin may be used which is used when the "vinyl resin having as partial structure a linkage formed by the reaction of a carboxyl group with an epoxy group" is produced.

The binder resin according to the present invention may also be incorporated with i) the vinyl resin having an epoxy group, ii) a resin mixture of the vinyl resin having a carboxyl group and the vinyl resin having an epoxy group or iii) the vinyl resin having a carboxyl group and an epoxy group. As these vinyl resins, the same ones as the vinyl resins may be used which are used when the "vinyl resin having as partial structure a linkage formed by the reaction of a carboxyl group with an epoxy group" is produced.

The binder resin according to the present invention may also preferably have an acid value of from 1 to 50 mg·KOH/g, more preferably from 1 to 40 mg·KOH/g, and still more preferably from 2 to 40 mg·KOH/g. The use of the binder resin having such an acid value enables the acid value of the THF-soluble matter in the toner to be controlled within the desired range. Also, where the toner base particles contains a wax, it is preferable also in that the electrostatic attraction between the wax and the binder resin can be enhanced.

Besides, the binder resin according to the present invention may also contain such a polymer as shown below. For example, usable are homopolymers of styrene or styrene derivatives, such as polystyrene, poly-p-chlorostyrene, and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, and a styrene-acrylonitrile-indene copolymer; polyvinyl chloride, phenolic resins, natural-resin modified phenol resins, natural-resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, coumarone-indene resins, and petroleum resins. In the present invention, any of these optional-component resins may be contained in the binder resin in an amount of 30% by weight or less, and preferably 20% by weight or less.

The toner of the present invention may preferably be incorporated with a charge control agent. As charge control agents capable of controlling the toner to be negatively chargeable, organic metal complex salts and chelate compounds are effective, including monoazo metal complexes, acetylyacetone metal complexes, aromatic hydroxycarboxylic acid and aromatic dicarboxylic acid type metal complexes. Besides, they may include aromatic hydroxycarboxylic acids, aromatic mono- and polycarboxylic acids, and metal salts, anhydrides or esters thereof, and phenol derivatives such as bisphenol. Also, as charge control agents capable of controlling the toner to be negatively chargeable, azo type metal complexes represented by the following general formula (2) are preferred.

(2)

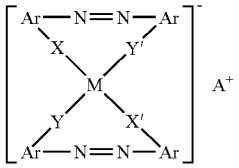

In the formula, M represents a central metal of coordination, such as Sc, Ti, V, Cr, Co, Ni, Mn or Fe; Ar represents an aryl group, such as a phenyl group or a naphthyl group, which may have a substituent such as a nitro group, a halogen atom, a carboxyl group, an anilide group and an alkyl group having 1 to 18 carbon atoms or an alkoxyl group having 1 to 18 carbon atoms; X, X', Y and Y' each represent —O—, —CO—, —NH— or —NR— (R is an alkyl group having 1 to 4 carbon atoms); $A^+$ represents a hydrogen ion, a sodium ion, a potassium ion, an ammonium ion or an aliphatic ammonium ion, or nothing.

In the charge control agents represented by the above general formula (2), as the central metal, Fe or Cr is particularly preferred. As the substituent, a halogen atom, an alkyl group or an anilide group is preferred. As the counter ion, a hydrogen ion, an alkali metal ammonium ion or an aliphatic ammonium ion is preferred. A mixture of complexes having different counter ions may also preferably be used.

The charge control agents capable of controlling the toner to be negatively chargeable may also include, e.g., basic organic acid metal complexes represented by the following general formula (3).

(3)

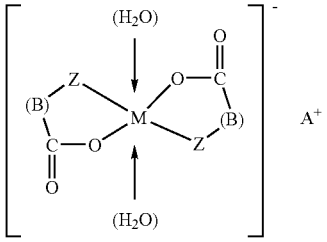

In the formula, M represents a central metal of coordination, including Cr, Co, Ni, Mn, Fe, Zn, Al, Si and B; B represents

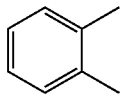

(which may have a substituent such as an alkyl group)

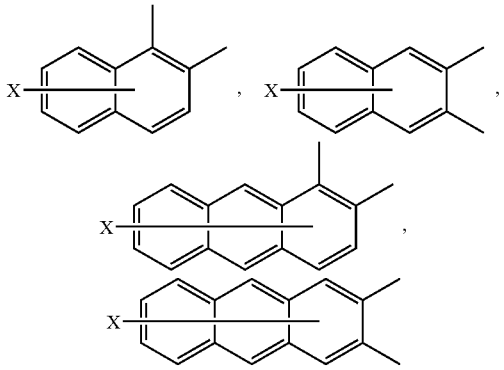

(X represents a hydrogen atom, a halogen atom, a nitro group or an alkyl group), and

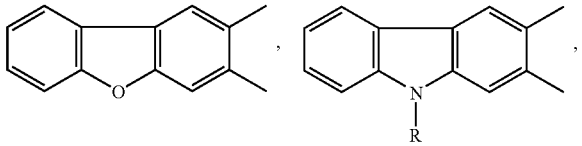

-continued

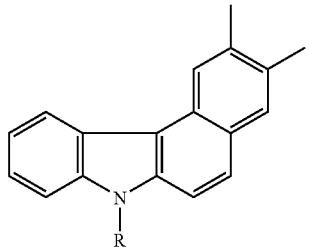

(R represents a hydrogen atom, an alkyl group having 1 to 18 carbon atoms or an alkenyl group having 2 to 16 carbon atoms); A'+ represents a hydrogen ion, a sodium ion, a potassium ion, an ammonium ion, an aliphatic ammonium ion, or nothing; Z represents —O— or

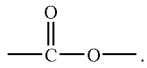

In the charge control agents represented by the above general formula (3), as the central metal, Fe, Cr, Si, Zn or Al is particularly preferred. As the substituent, an alkyl group, an anilide group, an aryl group or a halogen atom is preferred. As the counter ion, a hydrogen ion, an ammonium or an aliphatic ammonium ion is preferred.

Of the charge control agents represented by the above general formula (3), the azo type metal complexes are preferred. Further, azo type metal complexes represented by the following general formula (4) are most preferred.

(4)

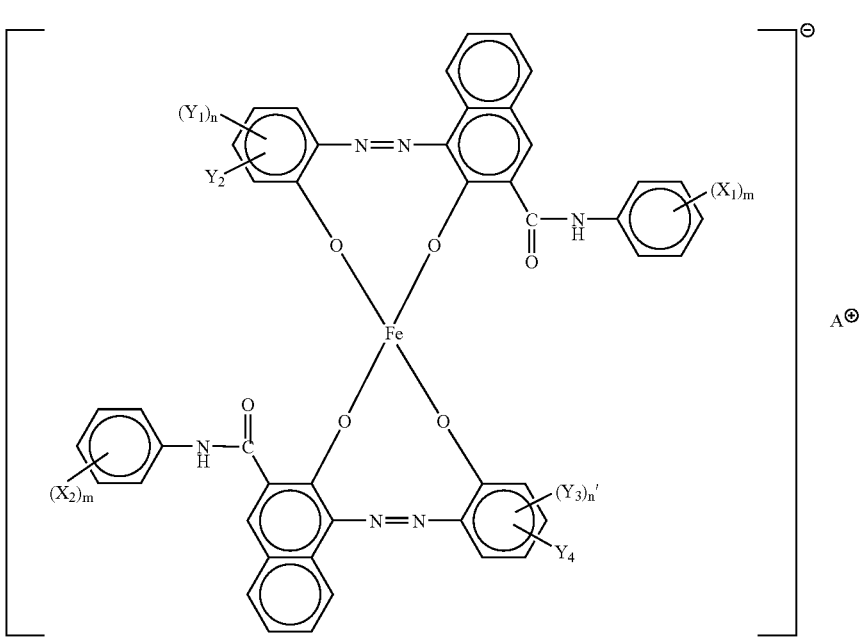

wherein $X_1$ and $X_2$ each represent a hydrogen atom, a lower alkyl group, a lower alkoxyl group, a nitro group or a halogen atom, and m and m' each represent an integer of 1 to 3; $Y_1$ and $Y_3$ each represent a hydrogen atom, an alkyl group having 1 to 18 carbon atoms, an alkenyl group having 2 to 18 carbon atoms, a sulfonamide group, a mesyl group, a sulfonic acid group, a carboxyester group, a hydroxyl group, an alkoxyl group having 1 to 18 carbon atoms, an acetylamino group, a benzoyl group, an amino group or a halogen atom; n and n' each represent an integer of 1 to 3; and Y2 and Y4 each represent a hydrogen atom or a nitro group; (the above $X_1$ and $X_2$, m and m', $Y_1$ and $Y_3$, n and n', and Y2 and Y4 may be the same or different); and $A^+$ represents an ammonium ion, an alkali metal ion, a hydrogen ion or a mixed ion of any of these.

Specific examples of the azo type metal complex represented by the above formula (4) are shown below as the following structural formulas (5) to (10).

(5)

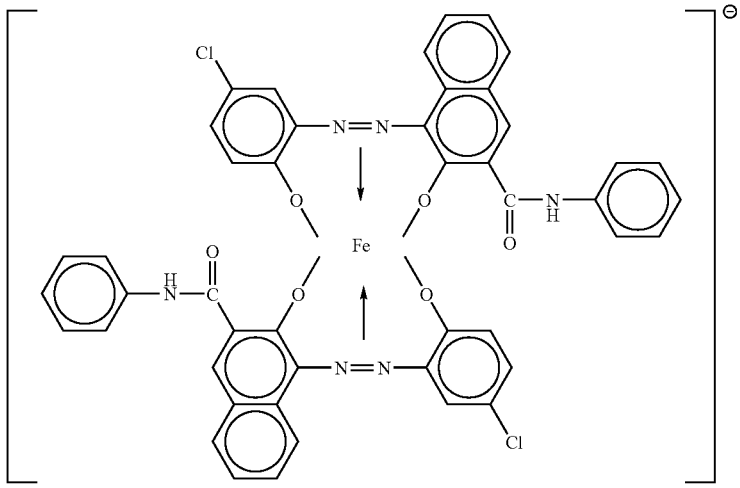

$NH4^+$ (or $H^+$, $Na^+$, $K^+$ or a mixed ion of any of these)

(6)

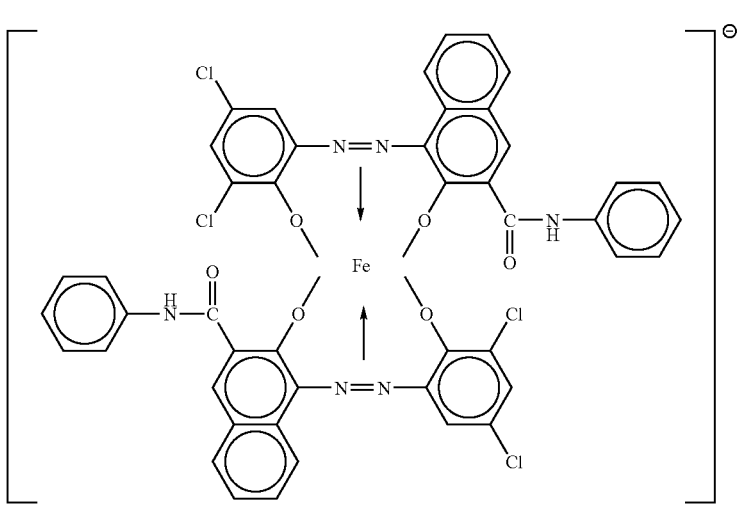

$NH4^+$ (or $H^+$, $Na^+$, $K^+$ or a mixed ion of any of these)

-continued
(7)
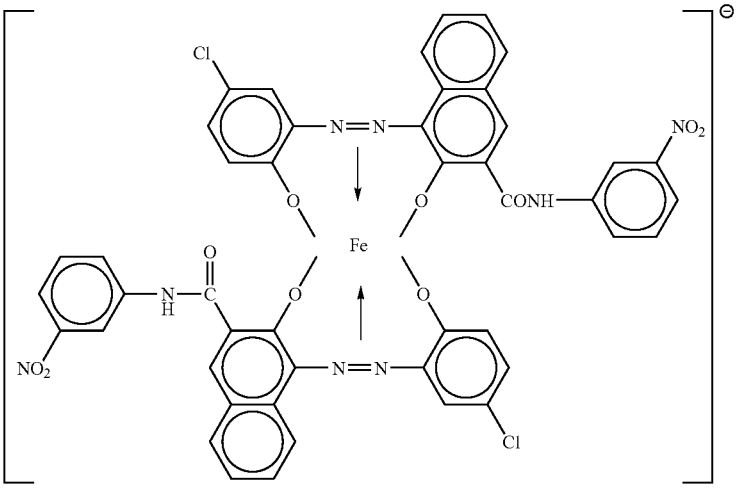
(8)
NH4+ (or H+, Na+, K+ or a mixed ion of any of these)
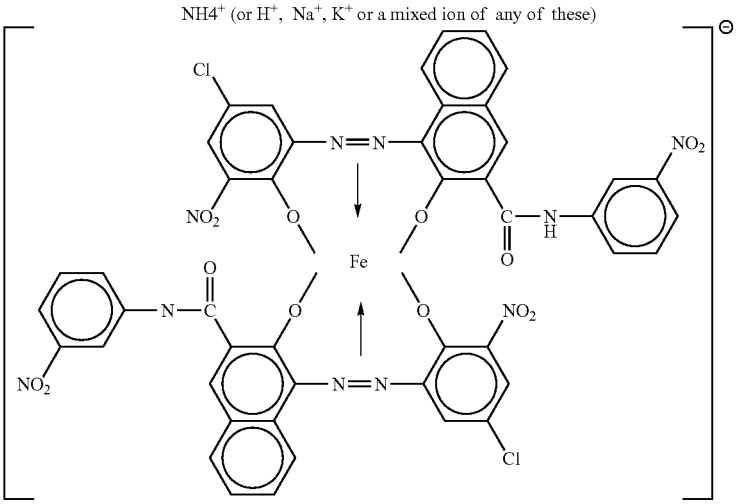
(9)
NH4+ (or H+, Na+, K+ or a mixed ion of any of these)
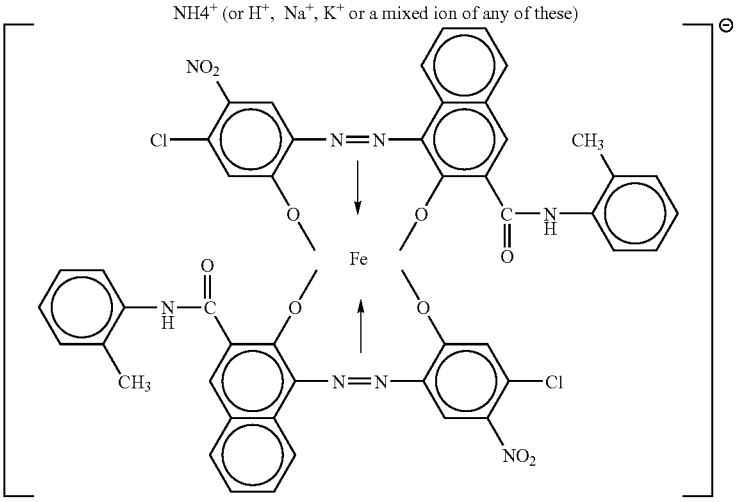
NH4+ (or H+, Na+, K+ or a mixed ion of any of these)

-continued (10)

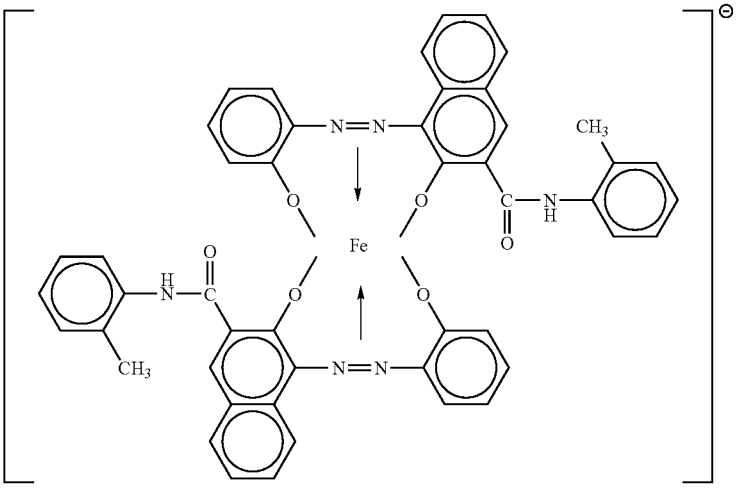

$NH4^+$ (or $H^+$, $Na^+$, $K^+$ or a mixed ion of any of these)

A charge control agent capable of controlling the toner to be positively chargeable may include, e.g., Nigrosine, and Nigrosine modified with a fatty acid metal salt; quaternary ammonium salts such as tributylbenzylammonium 1-hydroxy-4-naphthosulfonate and tetrabutylammonium teterafluoroborate, and analogues of these, i.e., onium salts such as phosphonium salts, and lake pigments of these, triphenylmethane dyes and lake pigments of these (lake-forming agents include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate; guanidine compounds, and imidazole compounds. Any of these may be used alone or in a combination of two or more kinds. Of these, triphenylmethane compounds, and quaternary ammonium salts whose counter ions are not halogens may preferably be used.

Homopolymers of monomers represented by the following general formula (11); or copolymers of polymerizable monomers such as styrene, acrylates or methacrylates as described above may also be used as positive charge control agents. In this case, these charge control agents serve also as binder resins (as a whole or in part).

(11)

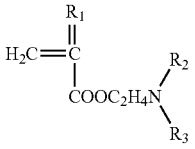

In the above formula (11), $R_1$ represents a hydrogen atom or a methyl group; $R_2$ and $R_3$ each represent a substituted or unsubstituted alkyl group (preferably having 1 to 4 carbon atoms).

As the positively chargeable charge control agents, compounds represented by the following general formula (12) are particularly preferred:

(12)

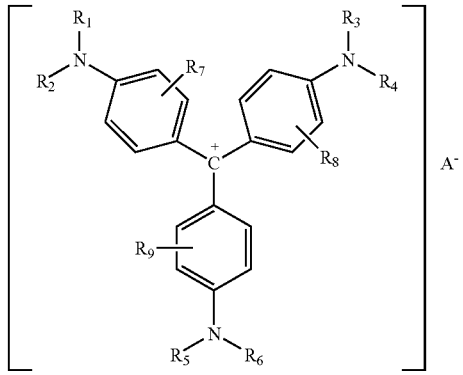

wherein $R_1$, $R_2$, $R_3$, $R_4$, $R_5$ and $R_6$ may be the same or different from one another and each represent one or two or more selected from the group consisting of a hydrogen atom, a substituted or unsubstituted alkyl group and a substituted or unsubstituted aryl group; $R_7$, $R_8$ and $R_9$ may be the same or different from one another and each represent one or two or more selected from the group consisting of a hydrogen atom, a halogen atom, an alkyl group and an alkoxyl group; and $A^-$ represents a negative ion selected from a sulfate ion, a borate ion, a phosphate ion, a carboxylate ion, an organic borate ion and tetrafluorborate.

In specific trade names, agents for negative charging may be exemplified by Spilon Black TRH, T-77, T-95 (available from Hodogaya Chemical Co., Ltd.); BONTRON (registered trademark) S-34, S-44, S-54, E-84, E-88, E-89 (available from Orient Chemical Industries Ltd.). Those preferable as agents for positive charging may include, e.g., TP-302, TP-415 (available from Hodogaya Chemical Co., Ltd.); BONTRON (registered trademark) N-01, N-04, N-07, P-51 (available from Orient Chemical Industries Ltd.), and Copy Blue PR (Klariant GmbH).

As methods for incorporating the toner with the charge control agent, available are a method of internally adding it to toner base particles and a method of externally adding it to toner base particles. The amount of the charge control agent used is determined according to the toner production method including the type of binder resin, the presence or absence of any other additives, the dispersing way, and can not absolutely be specified. In general, the charge control agent may be used preferably in an amount of from 0.1 to 10 parts by weight, and more preferably from 0.1 to 5 parts by weight, based on 100 parts by weight of the binder resin.

The toner of the present invention may be incorporated with a wax. The wax used in the present invention may include the following: for example, paraffin wax and derivatives thereof, montan wax and derivatives thereof, microcrystalline wax and derivatives thereof, Fischer-Tropsch wax and derivatives thereof, polyolefin wax and derivatives thereof, and carnauba wax and derivatives thereof. The derivatives may include oxides, block copolymers with vinyl monomers, and graft modified products.

Specific examples of the wax may include BISKOL (registered trademark) 330-P, 550-P, 660-P, TS-200 (available from Sanyo Chemical Industries, Ltd.); HIWAX 400P, 200P, 100P, 410P, 420P, 320P, 220P, 210P, 110P (available from Mitsui Chemicals, Inc.); SASOL H1, H2, C80, C105, C77 (available from Schumann Sasol Co.); HNP-1, HNP-3, HNP-9, HNP-10, HNP-11, HNP-12 (available from Nippon Seiro Co., Ltd.); UNILIN (registered trademark) 350, 425, 550, 700, UNICID (registered trademark) 350, 425, 550, 700 (available from Toyo-Petrolite Co., Ltd.); and japan wax, bees wax, rice wax, candelilla wax, carnauba wax (available from CERARICA NODA Co., Ltd.).

In the present invention, it is effective that any of these waxes is used in a total content of from 0.1 to 15 parts by weight, and preferably from 0.5 to 12 parts by weight, based on 100 parts by weight of the binder resin.

It is preferable for these waxes to have a melting point of from 65° C. or more to less than 130° C., preferably from 70° C. or more to less than 120° C., and more preferably from 70° C. or more to less than 110° C., as measured with a differential thermal analyzer, differential scanning calorimeter (DSC). The wax with such a melting point has an appropriate hardness, and the toner base particles having the desired circularity, particle size distribution and average surface roughness can effectively be obtained through the step of modifying the surfaces of toner base particles. If the wax has a melting point of less than 65° C., the toner may have poor storage stability. If the wax has a melting point of 130° C. or more, the toner base particles may be so hard as to result in poor productivity of the surface-modified toner particles.

The toner base particles of the present invention contain a colorant.

A magnetic material may be used serving also as the colorant. The magnetic material to be used in the toner may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

These magnetic materials may preferably be those having a number-average particle diameter of from 0.05 μm to 1.0 μm, and more preferably from 0.1 μm to 0.5 μm. As the magnetic material, preferably usable are those having a BET specific surface area of from 2 to 40 $m^2$/gs, and more preferably from 4 to 20 $m^2$/g. There are no particular limitations on their particle shapes, and any desired shapes may be used. Referring to magnetic properties, the magnetic material may have a saturation magnetization of from 10 to 200 $Am^2$/kg (preferably from 70 to 100 $Am^2$/kg), a residual magnetization of from 1 to 100 $Am^2$/kg (preferably from 2 to 20 $Am^2$/kg) and a coercive force of from 1 to 30 kA/m (preferably from 2 to 15 kA/m) under application of a magnetic field of 795.8 kA/m. Any of these magnetic materials may be used in an amount of from 20 to 200 parts by weight, and preferably from 40 to 150 parts by weight, based on 100 parts by weight of the binder resin.

The number-average particle diameter can be determined by using a digitizer to measure a photograph taken with a transmission electron microscope or the like. The magnetic properties of the magnetic material can be measured with "Vibration Sample Type Magnetism Meter VSM 3S-15" (manufactured by Toei Industry Co., Ltd.) under application of an external magnetic field of 795.8 kA/m. To measure the specific surface area, according to the BET method and using a specific surface area measuring instrument AUTOSOBE 1 (manufactured by Yuasa Ionics Co.), nitrogen gas is adsorbed on the surface of a sample, and the BET specific surface area is calculated using the BET multi-point method.

As for other colorants usable in the toner of the present invention, they include any suitable pigments and dyes. The pigments may include carbon black, Aniline Black, acetylene black, Naphthol Yellow, Hanza Yellow, Rhodamine Lake, Alizarine Lake, red iron oxide, Phthalocyanine Blue and Indanethrene Blue. Any of these may be used in an amount necessary for maintaining optical density of fixed images, and may be added in an amount of from 0.1 to 20 parts by weight, and preferably from 0.2 to 10 parts by weight, based on 100 parts by weight of the binder resin. The dyes may include azo dyes, anthraquinone dyes, xanthene dyes and methine dyes. The dye may be added in an amount of from 0.1 to 20 parts by weight, and preferably from 0.3 to 10 parts by weight, based on 100 parts by weight of the binder resin.

Inorganic fine particles are externally added to the toner base particles in the present invention. For example, they may include fine silica powder, fine titanium oxide powder, and products thereof subjected to hydrophobic treatment. These may preferably be used alone or in combination.

The fine silica powder may include both of silica called dry-process silica or fumed silica produced by vapor phase oxidation of silicon halides and wet-process silica produced from water glass or the like. The dry-process silica is preferred having less silanol groups inside, and on the surfaces of, the fine silica particles and leaving less production residues.

Further, as the fine silica powder, one having been subjected to hydrophobic treatment is preferred. The fine silica powder may be made hydrophobic by chemical treatment with an organosilicon compound capable of reacting with or physically adsorptive on the fine silica powder. As a preferable method, a method is named in which the dry-process fine silica powder produced by vapor phase oxidation of a silicon halide is treated with an organosilicon compound such as silicone oil after having been treated with a silane compound or along with the treatment with a silane compound.

The silane compound used in the hydrophobic treatment may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, and 1,3-diphenyltetramethyldisiloxane.

The organosilicon compound may include silicone oils. Preferred is the use of silicone oils having a viscosity at 25° C. of from 30 to 1,000 $mm^2/s$. For example, the following are preferred: dimethylsilicone oil, methylphenylsilicone oil, α-methylstyrene modified silicone oil, chlorophenylsilicone oil and fluorine modified silicone oil.

As a method for the treatment with silicone oil, a method may be employed in which the fine silica powder treated with a silane compound and the silicone oil are directly mixed by means of a mixing machine such as Henschel mixer, or the silicone oil is sprayed on the fine silica powder as a base. Besides, the silicone oil may be dissolved or dispersed in a suitable solvent and thereafter the base fine silica powder may be mixed, followed by removal of the solvent to prepare the treated product.

As preferable hydrophobic treatment of the fine silica powder, a method is available in which the fine silica powder is first treated with hexamethyldisilazane and then treated with silicone oil to prepare the treated product.

It is preferable to treat the fine silica powder with a silane compound and thereafter conduct the treatment with silicone oil as described above, because the hydrophobicity can effectively be improved.

The above hydrophobic treatment made on the fine silica powder and further the treatment with silicone oil may be made also on fine titanium oxide powder. Such powder is also preferable as with the silica type.

To the toner base particles in the present invention, additives other than the fine silica powder or fine titanium oxide powder may be externally added as needed.

For example, they are fine resin particles or inorganic fine particles that function as a charge auxiliary agent, a conductivity-providing agent, a fluidity-providing agent, an anti-caking agent, a release agent at the time of heat roll fixing, a lubricant and an abrasive.

As the fine resin particles, those having an average particle diameter of from 0.03 μm to 1.0 μm are preferred. A polymerizable monomer constituting that resin may include monomers as exemplified by styrene; styrene derivatives such as o-methylstyrene, m-methylstyrene, p-methylstyrene, p-methoxystyrene and p-ethylstyrene; acrylic acid; methacrylic acid; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and acrylonitrile, methacrylonitrile and acrylamides.

The polymerization process may include suspension polymerization, emulsion polymerization and soap-free polymerization, and more preferably soap-free polymerization.

Other fine particles may include lubricants such as polyfluoroethylene powder, zinc stearate powder and polyvinylidene fluoride powder (in particular, polyvinylidene fluoride powder is preferred); abrasives such as cerium oxide powder, silicon carbide powder and strontium titanate powder (in particular, strontium titanate powder is preferred); fluidity-providing agents such as titanium oxide powder and aluminum oxide powder (in particular, hydrophobic one is preferred); anti-caking agents; and conductivity-providing agents such as carbon black, zinc oxide powder, antimony oxide powder and tin oxide powder. White fine particles and black fine particles having a polarity opposite to that of the toner may also be used as a developing performance improver in a small quantity.

The fine resin particles, inorganic fine particles or hydrophobic inorganic fine particles to be blended with the toner base particles may be used in an amount of from 0.01 to 5 parts by weight, and preferably from 0.01 to 3 parts by weight, based on 100 parts by weight of the toner base particles.

The toner of the present invention may preferably have a weight-average particle diameter of from 2.5 μm to 10.0 μm, more preferably from 5.0 μm to 9.0 μm, and still more preferably from 6.0 μm to 8.0 μm, where a sufficient effect can be brought about desirably.

The weight-average particle diameter and particle size distribution of the toner are measured by the Coulter Counter method. For example, Coulter Multisizer (manufactured by Coulter Electronics, Inc.) may be used. As an electrolytic solution, a 1% NaCl aqueous solution is prepared using first-grade sodium chloride. For example, ISOTON R-II (available from Coulter Scientific Japan Co.) may be used. Measurement is made by adding as a dispersant 0.1 to 5 ml of a surface active agent (preferably alkylbenzenesulfonate) to 100 to 150 ml of the above aqueous electrolytic solution, and further adding 2 to 20 mg of a sample for measurement. The electrolytic solution in which the sample has been suspended is subjected to dispersion for about 1 minute to about 3 minutes in an ultrasonic dispersion machine. The volume distribution and number distribution of the toner are calculated by measuring the volume and number of toner particles having diameters of 2.00 μm or more by means of the above measuring instrument, using an aperture of 100 μm as its aperture. Then the weight-based, weight average particle diameter (D4) according to the present invention, determined from the volume distribution, is calculated. As channels, 13 channels are used, which are 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

The toner of the present invention may be used as a two-componet developer in combination with a carrier. As the carrier used in two-component development, a conventionally known carrier may be used. Stated specifically, usable as the carrier are particles formed of a metal such as iron, nickel, cobalt, manganese, chromium or a rare earth element, or an alloy or an oxide thereof, having been surface-oxidized or unoxidized and having an average particle diameter of from 20 μm to 300 μm.

Preferred is a carrier on the particle surfaces of which a material such as a styrene resin, an acrylic resin, a silicone resin, a fluorine resin or a polyester resin has been deposited or applied.

The toner base particles according to the present invention are obtained by melt-kneading a composition containing the binder resin, the magnetic material and optionally other components (kneading step), and pulverizing the kneaded product (pulverization step). Constituent materials of the toner base particles may preferably be well mixed by means of a ball mill or any other mixing machine, followed by sufficient kneading using a heat kneading machine. The pulverization step may also be divided into a crushing step and a fine grinding step. Also, as a post step thereof, classification may be carried out (classification step). Further, in order to satisfy the average circularity and average surface roughness of the toner base particles and toner particles according to the present invention, it is preferable to modify the toner base particle surfaces by means of the surface modification apparatus in such a manner as described previously. In particular, it is preferable to carry out the surface modification after the classification step. It is also preferable to carry out the removal of fine powder and the surface modification simultaneously.

Where the toner particles are produced through the kneading step, the constituent materials of the toner base particles can uniformly and finely be dispersed in the particles. Since the kneaded product in which the constituent materials have been suitably dispersed is pulverized, the constituent materials can favorably be distributed at the toner base particle surfaces, so that the effect attributable to the toner base particles having the specific average surface roughness and average circularity characteristic of the present invention can sufficiently be brought about. Where the toner base particles are produced not through the kneading step and classification step, it is difficult to control the distribution of constituent materials at the toner base particle surfaces, and no sufficient effect tends to be brought about even if the toner base particles have proper average surface roughness and average circularity.

As the mixing machine, it may include, e.g., Henschel Mixer (manufactured by Mitsui Mining & Smelting Co., Ltd.); Super Mixer (manufactured by Kawata MFG Co., Ltd.); Conical Ribbon Mixer (manufactured by Y. K. Ohkawara Seisakusho); Nauta Mixer, Turbulizer, and Cyclomix (manufactured by Hosokawa Micron Corporation); Spiral Pin Mixer (manufactured by Pacific Machinery & Engineering Co., Ltd.); and Rhedige Mixer (manufactured by Matsubo Corporation). As the kneading machine, it may include KRC Kneader (manufactured by Kurimoto, Ltd.); Buss-Kneader (manufactured by Coperion Buss Ag.); TEM-type Extruder (manufactured by Toshiba Machine Co., Ltd.); TEX Twin-screw Extruder (manufactured by The Japan Steel Works, Ltd.); PCM Kneader (manufactured by Ikegai Corp.); Three-Roll Mill, Mixing Roll Mill, and Kneader (manufactured by Inoue Manufacturing Co., Ltd.); Kneadex (manufactured by Mitsui Mining & Smelting Co., Ltd.); MS-type Pressure Kneader, and Kneader-Ruder (manufactured by Moriyama Manufacturing Co., Ltd.); and Banbury Mixer (manufactured by Kobe Steel, Ltd.).

As the grinding machine, it may include Counter Jet Mill, Micron Jet, and Inomizer (manufactured by Hosokawa Micron Corporation); IDS-type Mill, and PJM Jet Grinding Mill (manufactured by Nippon Pneumatic MFG Co., Ltd.); Cross Jet Mill (manufactured by Kurimoto, Ltd.); Ulmax (manufactured by Nisso Engineering Co., Ltd.); SK Jet O-Mill (manufactured by Seishin Enterprise Co., Ltd.); Criptron (manufactured by Kawasaki Heavy Industries, Ltd); Turbo Mill (manufactured by Turbo Kogyo Co., Ltd.); and Super Rotor (manufactured by Nisshin Engineering Inc.). As the classifier, it may include Classyl, Micron Classifier, and Spedic Classifier (manufactured by Seishin Enterprise Co., Ltd.); Turbo Classifier (manufactured by Nisshin Engineering Inc.); Micron Separator, Turboprex (ATP), and TSP Separator (manufactured by Hosokawa Micron Corporation); Elbow Jet (manufactured by Nittetsu Mining Co., Ltd.); Dispersion Separator (manufactured by Nippon Pneumatic MFG Co., Ltd.); and YM Microcut (manufactured by Yasukawa Shoji K.K.). As a sifter used to sieve coarse powder and so forth, it may include Ultrasonics (manufactured by Koei Sangyo Co., Ltd.); Rezona Sieve, and Gyro Sifter (manufactured by Tokuju Corporation); Vibrasonic Sifter (manufactured by Dulton Company Limited); Sonicreen (manufactured by Shinto Kogyo K.K.); Turbo-Screener (manufactured by Turbo Kogyo Co., Ltd.); Microsifter (manufactured by Makino Mfg. Co., Ltd.); and circular vibrating screens.

Physical properties of the toner and respective components according to the present invention are measured by the following methods.

(I) Molecular Weight Distribution of Toner and Raw-Material Resin:

In the present invention, the molecular weight distribution of the THF-soluble matter of the toner and raw-material resin is measured by GPC (gel permeation chromatography) under the following conditions.

Columns are stabilized in a heat chamber of 40° C. To the columns kept at this temperature, THF as a solvent is flowed at a flow rate of 1 ml per minute, and about 100 μl of a THF sample solution is injected thereinto to make measurement. In measuring the molecular weight of the sample, the molecular weight distribution ascribed to the sample is calculated from the relationship between the logarithmic value of a calibration curve prepared using several kinds of monodisperse polystyrene standard samples and the value of count. As the standard polystyrene samples used for the preparation of the calibration curve, samples with molecular weights of from 100 to 10,000,000, which are available from, e.g., Tosoh Corporation or Showa Denko K.K., may be used and at least about 10 standard polystyrene samples may be used. An RI (refractive index) detector is used as a detector. Columns should be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$) and TSK guard column, available from Tosoh Corporation.

The sample is prepared in the following way.

The sample is put in THF, and is left for several hours, followed by thorough shaking so as to be well mixed with the THF (until coalescent matter of the sample has disappeared), which is further left for at least 12 hours. Here, the sample is so left as to stand in THF for at least 24 hours. Thereafter, the solution having been passed through a sample-treating filter (pore size: 0.2 to 0.5 μm; for example, MAISHORIDISK H-25-5, available from Tosoh Corporation, may be used) is used as the sample for GPC. The sample is so adjusted as to have resin components in a concentration of from 0.5 to 5 mg/ml.

(II) THF-Insoluble Matter Content:

2.0 g of a sample is weighed out, which is then put in a cylindrical filter paper (e.g., No. 86R, available from Toyo Roshi K.K.) and set on a Soxhlet extractor. Extraction is carried out for 16 hours using 200 ml of THF as a solvent. At this point, extraction is carried out at such a reflux speed that the extraction cycle of the solvent is one time per about 4 to 5 minutes. After the extraction is completed, the cylindrical filter paper is taken out, and then vacuum-dried at 40° C. for 8 hours, where the extraction residue is weighed. The insoluble matter is expressed by $(W_2/W_1)\times 100$ (% by weight) where the weight of the resin component introduced first is represented by $W_1$ g, and the weight of the resin component in the extraction residue by $W_2$ g. For example, in the case of a magnetic toner, it may be calculated according to the above expression, from weight $W_1$ g found by subtracting the weight of the insoluble matter other than the resin, such as the magnetic material and the pigment, from the weight of the sample toner and weight $W_2$ g found by subtracting the weight of the insoluble matter, such as the magnetic material and the pigment, from the weight of the extraction residue.

(III) Acid Value of Toner THF-Soluble Matter and That of Raw-Material Binder Resin:

In the present invention, the acid value (JIS acid value) of toner THF-soluble matter and that of raw-material binder resin are determined by the following method. The acid value of the raw-material binder resin means the acid value of the THF-soluble matter of the raw-material binder resin.

Basic operation is made according to JIS K-0070.

(1) A sample is used after the THF-insoluble matter of the toner and raw-material binder resin have been removed, or the soluble component obtained in the above measurement of THF-insoluble matter, which has been extracted with THF solvent by means of the Soxhlet extractor, is used as a sample. A crushed product of the sample is precisely weighed in an amount of from 0.5 g to 2.0, and the weight of the soluble component is represented by W (g).

(2), The sample is put in a 300 ml beaker, and 150 ml of a toluene/ethanol (4/1) mixed solvent is added thereto to dissolve the sample.

(3) Using an ethanol solution of 0.1 mol/l of KOH, titration is made by means of a potentiometric titrator (for example, automatic titration may be utilized which is made using a potentiometric titrator AT-400, WIN WORKSTATION, and an ABP-410 motor buret, both manufactured by Kyoto Electronics Manufacturing Co., Ltd.).

(4) The amount of the KOH solution used here is represented by S (ml). A blank test not using any sample is conducted at the same time, and the amount of the KOH solution used in this blank test is represented by B (ml).

(5) The acid value is calculated according to the following expression. Letter symbol f is the factor of KOH.

$$\text{Acid value (mg·KOH/g)}=\{(S-B)\times f\times 5.61\}/W.$$

(IV) Glass Transition Temperature of Toner:

The glass transition temperature (Tg) of the resin is measured according to ASTM D3418-82, using a differential scanning calorimeter (DSC measuring instrument) DSC-7 (manufactured by Perkin-Elmer Corporation), DSC2920 (manufactured by TA Instruments Japan Ltd.) or the like.

A sample for measurement is precisely weighed in an amount of 5 mg to 20 mg, and preferably 10 mg. This sample is put in an aluminum pan and an empty aluminum pan is used as reference. Measurement is made in a normal-temperature and normal-humidity environment (25° C./60% RH) at a heating rate of 10° C./min within the measurement range of from 30° C. to 200° C. In this temperature rise process, the change of the specific heat is measured. The intersection of the center line between the base lines of the differential thermal curve before and after the appearance of the change of the specific heat within the temperature range of 40° C. to 100° C. and the differential thermal curve is regarded as the glass transition temperature (Tg).

(V) Measurement of Epoxy Value:

Basic operation is made according to JIS K-7236.

(1) A sample is precisely weighed in an amount of from 0.5 g to 2.0 g, and its weight is represented by W (g).

(2) The sample is put in a 300 ml beaker, and is dissolved in a mixture of 10 ml of chloroform and 20 ml of acetic acid.

(3) To the solution obtained in the step (2), 10 ml of tetraethylammonium bromide acetic acid solution (prepared by dissolving 100 g of tetraethylammonium bromide in 400 ml of acetic acid) is added. Using a 0.1 mol/l perchloric acid acetic acid solution, titration is made by means of a potentiometric titrator (for example, automatic titration may be utilized which is made using a potentiometric titrator AT-400, WIN WORKSTATION, and an ABP-410 motor buret, both manufactured by Kyoto Electronics Manufacturing Co., Ltd.). The amount of the perchloric acid acetic acid solution used here is represented by S (ml). A blank using no sample is measured at the same time, and the amount of the perchloric acid acetic acid solution used in this blank is represented by B (ml). The epoxy value is calculated from the following expression. Letter symbol f is the factor of the perchloric acid acetic acid solution.

$$\text{Epoxy value (eq/kg)}=\{0.1\times f\times(S-B)\}/W.$$

(VI) Molecular Weight Distribution of Wax:

In the present invention the molecular weight distribution of the wax is measured by gel permeation chromatography (GPC) under the following conditions.

GPC Measuring Conditions

Apparatus: HLC-8121GPC/HT (manufactured by Tosoh Corporation).

Columns: TSKgel GMHHR-H HT 7.8 cm I.D×30 $cm^2$, combination of columns (available from Tosoh Corporation).

Detector: RI for high temperature.

Temperature: 135° C.

Solvent: o-Dichlorobenzene (0.05% ionol-added)

Flow rate: 1.0 ml/min.

Sample: 0.4 ml of 0.1% sample is injected.

Measurement is carried out under the conditions shown above. The Molecular weight of the sample is calculated using a molecular weight calibration curve prepared from a monodisperse polystyrene standard sample, and converted into polyethylene by a conversion equation derived from the Mark-Houwink viscosity equation.

(VII) Melting Point of Wax:

In the present invention, the melting point of the wax may be measured using a differential thermal analyzer, differential scanning calorimeter (DSC measuring instrument) DSC-7 (manufactured by Perkin-Elmer Corporation), DSC2920 (manufactured by TA Instruments Japan Ltd.) or the like.

Measurement is made basically according to ASTM D3418.

Sample: 0.5 to 2 mg, preferably 1 mg.

Measuring method: The sample is put in an aluminum pan, and an empty aluminum pan is used as reference.

Temperature Curve:

Heating I (20° C. to 180° C.; heating rate: 10° C./min)

Cooling I (180° C. to 10° C.; cooling rate: 10° C./min)

Heating II (10° C. to 180° C.; heating rate: 10° C./min).

In the above temperature curve, the endothermic peak temperature measured at Heating II is regarded as the melting point.

EXAMPLES

The present invention is described below in greater detail by giving Examples. The present invention is by no means limited to these.

The types and melting points of waxes used in the present invention are shown in Table 1.

TABLE 1

Type and Analytical Value of Wax

| | Type | Melting point (° C.) | Number-average molecular weight | Weight-average molecular weight |
|---|---|---|---|---|
| Wax I-1 | Paraffin | 76 | 380 | 500 |
| Wax I-2 | Fischer-Tropsch | 105 | 790 | 1,180 |
| Wax I-3 | Polyethylene | 120 | 2,250 | 3,390 |
| Wax I-4 | Polypropylene | 145 | 1,000 | 8,880 |

Resin production processes are shown below.

Production Example A-1 of High-Molecular Weight Component

| | (by weight) |
|---|---|
| Styrene | 78.0 parts |
| n-Butyl acrylate | 20.0 parts |
| Methacrylic acid | 2.0 parts |
| 2,2-Bis(4,4-di-t-butylperoxycyclohexyl)propane | 0.8 part |

While stirring of 200 parts by weight of xylene in a four-necked flask, the inside atmosphere of the container was sufficiently displaced with nitrogen and was heated to 120° C., and thereafter the above materials were dropwise added thereto over a period of 4 hours. Further, with retention for 10 hours under reflux of xylene, polymerization was completed, and the solvent was distilled off under reduced pressure. The resin thus obtained is designated as High-Molecular Weight Component A-1. Physical properties of the resin obtained are shown in Table 2.

Production Examples A-2 to A-4 of High-Molecular Weight Component

High-Molecular Weight Components A-2 to A-4 were obtained in the same manner as in Production Example A-1 except that the material formulated in Production Example A-1 was changed as shown in Table 2.

TABLE 2

Formulation and Physical Properties of High-Molecular Weight Component

| High-Molecular Weight Component: | Formulation St | BA | MA | AA | BPCP | GPC Mw | Mn | Peak | THF-insoluble matter (%) | Acid value (mgKOH/g) |
|---|---|---|---|---|---|---|---|---|---|---|
| | ------(part(s) by weight)----- | | | | | | | | | |
| A-1 | 78.0 | 20.0 | 2.0 | — | 0.8 | 310,000 | 80,000 | 25,000 | 0 | 14.7 |
| A-2 | 83.0 | 16.2 | 0.8 | — | 0.7 | 360,000 | 92,000 | 270,000 | 0 | 5.8 |
| A-3 | 74.2 | 18.2 | — | 7.6 | 1.0 | 260,000 | 5,000 | 180,000 | 0 | 61.0 |
| A-4 | 86.5 | 13.5 | — | — | 0.6 | 380,000 | 110,000 | 290,000 | 0 | 0.0 |

St: Styrene;
BA: n-Butyl acrylate;
MA: Methacrylic acid;
AA: Acrylic acid
BPCP: 2,2-Bis(4,4-di-t-butylperoxycyclohexyl)propane

Production Example B-1 of Vinyl Resin Having Carboxyl Group

| | (by weight) |
|---|---|
| High-Molecular Weight Component A-1 | 30 parts |
| Styrene | 55.5 parts |
| n-Butyl acrylate | 13.8 parts |
| Methacrylic acid | 0.7 part |
| Di-tert-butyl peroxide | 1.4 parts |

200 parts by weight of xylene was heated to 200° C. Thereafter, of materials in the above formulation, compounds except for High-Molecular Weight Component A-1 were dropwise added to the xylene over a period of 4 hours. Further, with retention under reflux of xylene for 1 hour, polymerization was completed. Then, High-Molecular Weight Component A-1 was added to the xylene solution, and throughly mixed. Thereafter, the solvent was distilled off under reduced pressure. The resin thus obtained is designated as Vinyl Resin B-1. Physical properties of the resin obtained are shown in Table 3.

Production Examples B-2 and B-3 of Vinyl Resin Having Carboxyl Group

Vinyl Resins B-2 and B-3 were obtained in the same manner as in Production Example B-1 except that the materials formulated in Production Example B-1 were changed as shown in Table 3. Physical properties of the resin obtained are shown in Table 3.

Production Example B-4 of Vinyl Resin Having No Carboxyl Group

Vinyl Resins B-4 was obtained in the same manner as in Production Example B-1 except that the materials formulated in Production Example B-1 were changed as shown in Table 3. Physical properties of the resin obtained are shown in Table 3.

TABLE 3

Physical Properties of Vinyl Resin Having Carboxyl Group

| Vinyl Resin: | High-molecular wt. component (pbw) | Formulation St | BA | MA | AA | DTBP | GPC Mw | Mn | peak | High-molecular Main side peak | THF-insoluble matter (%) | Acid value (mgKOH/g) | Tg (° C.) |
|---|---|---|---|---|---|---|---|---|---|---|---|---|---|
| | | ----(part(s) by weight)--- | | | | | | | | | | | |
| B-1 | A-1 (30.0) | 55.5 | 13.8 | 0.7 | — | 1.4 | 94,000 | 7,000 | 12,000 | 200,000 | 0 | 7.8 | 58.1 |
| B-2 | A-2 (30.0) | 54.8 | 15.1 | 0.1 | — | 1.1 | 120,000 | 9,600 | 17,000 | 210,000 | 0 | 1.8 | 59.2 |
| B-3 | A-3 (30.0) | 54.6 | 11.9 | — | 3.5 | 1.7 | 85,000 | 6,000 | 8,000 | 120,000 | 0 | 31.7 | 55.2 |
| B-4 | A-4 (50.0) | 40.0 | 10.0 | — | — | 1.0 | 130,000 | 7,000 | 12,000 | 290,000 | 0 | 0.0 | 61.5 |

St: Styrene;
BA: n-Butyl acrylate;
MA: Methacrylic acid;
AA: Acrylic acid
DTBP: Di-t-butyl peroxide Production Example C-1 of Vinyl Resin Having Epoxy Group

| | (by weight) |
|---|---|
| Styrene | 75.2 parts |
| n-Butyl acrylate | 19.0 parts |
| Glycidyl methacrylate | 5.6 parts |
| Di-t-butyl peroxide | 5.0 parts |

200 parts by weight of xylene was put into a four-necked flask. The inside atmosphere of the container was sufficiently displaced with nitrogen, followed by heating to 170° C. with stirring. Thereafter, the above components were dropwise added thereto over a period of 4 hours. Further, under reflux of xylene, polymerization was completed, and the solvent was distilled off under reduced pressure. The resin thus obtained is designated as Vinyl Resin C-1. Physical properties of the resin obtained are shown in Table 4.

Production Examples C-2 and C-3 of Vinyl Resin Having Epoxy Group

Vinyl Resins C-2 and C-3B-4 were obtained in the same manner as in Production Example C-1 except that the materials formulated in Production Example C-1 were changed as shown in Table 4. Physical properties of the resin obtained are shown in Table 4.

TABLE 4

Physical Properties of Vinyl Resin Having Epoxy Group

| Resin: Vinyl | Formulation St | BA | GlyMA | BPCP | GPC Mw | Mn | THF-insoluble matter (%) | Epoxy value |
|---|---|---|---|---|---|---|---|---|
| | -----(part(s) by weight)---- | | | | | | | |
| C-1 | 75.2 | 19.0 | 5.6 | 5.0 | 7,800 | 6,500 | 0 | 0.4 |
| C-2 | 68.3 | 15.5 | 16.2 | 5.0 | 6,900 | 5,800 | 0 | 1.0 |
| C-3 | 76.7 | 20.5 | 2.8 | 5.0 | 6,000 | 5,000 | 0 | 0.2 |

St: Styrene;
BA: n-Butyl acrylate;
GlyMA: Glycidyl methacrylate;
DTBP: Di-t-butyl peroxide Binder Resin Production Example 1 (This Invention)

90 parts by weight of Vinyl Resin B-1 Having Carboxyl Group and 10 parts by weight of Vinyl Resin C-1 Having Epoxy Group were mixed by means of Henschel mixer. Thereafter, the mixture obtained was kneaded at 180° C. by means of a twin-screw extruder, followed by cooling and then pulverization to produce Binder Resin 1. A vinyl resin component having as partial structure the linkage formed by the reaction of a carboxyl group with an epoxy group was formed, so that THF-insoluble matter was produced in Binder Resin 1.

Physical properties of Binder Resin 1 are shown in Table 5.

Binder Resin Production Example 2 to 5 (This Invention) &

Binder Resin Production Examples 6 and 7

Comparative Examples

Binder Resins 2 to 7 were obtained in the same manner as in Production Example 1 except that the formulation was changed as shown in Table 5. In each of Binder Resins 2 to 5 as well, the vinyl resin component having as partial structure the linkage formed by the reaction of a carboxyl group with an epoxy group was formed, so that THF-insoluble matter was produced in each of Binder Resins 2 to 5.

Physical properties of the resins obtained are shown in Table 5.

TABLE 5

Binder Resin Physical Properties

| Binder Resin: | Binder resin: Resin component B | Binder resin: Resin component C | Binder resin: B/C proportion | GPC: Mw | GPC: Mn | GPC: Mp | THF-insoluble matter (%) | Acid value (mgKOH/g) |
|---|---|---|---|---|---|---|---|---|
| 1 | B-1 | C-1 | 90/10 | 85,000 | 8,000 | 13,500 | 16 | 7.3 |
| 2 | B-2 | C-1 | 90/10 | 110,000 | 9,000 | 15,000 | 25 | 1.6 |
| 3 | B-3 | C-1 | 90/10 | 70,000 | 6,800 | 11,500 | 12 | 31.0 |
| 4 | B-2 | C-2 | 90/10 | 140,000 | 11,000 | 18,000 | 35 | 1.0 |
| 5 | B-3 | C-3 | 90/10 | 60,000 | 5,500 | 9,000 | 6.0 | 36.0 |
| 6 | B-4 | C-1 | 90/10 | 160,000 | 13,000 | 20,000 | 0 | 0.0 |
| 7 | B-1 | — | 100/0 | 70,000 | 7,500 | 13,000 | 0 | 7.1 |

Example 1

| | (by weight) |
|---|---|
| Binder Resin 1 | 100 parts |
| Spherical magnetic iron oxide (average particle diameter: 0.21 μm; magnetic properties in a magnetic field of 79.58 kA/m (1 kOe), σr: 5.1 $Am^2/kg$ and σs: 69.6 $Am^2/kg$) | 95 parts |
| Wax 1 | 5 parts |
| Negative charge control agent (azo iron compound T-77, available from Hodogaya Chemical Co., Ltd.) | 2 parts |

The above materials were premixed by means of Henschel mixer, and thereafter the mixture obtained was melt-kneaded by means of a twin-screw kneader heated to 130° C. The kneaded product having been cooled was crushed by means of a hammer mill to produce a toner material crushed product. The crushed product was finely pulverized by using a mechanical grinding machine Turbo Mill (manufactured by Turbo Kogyo Co., Ltd.; the surfaces of its rotor and stator were coated by plating of a chromium alloy containing chromium carbide (plating thickness: 150 μm; surface hardness: HV 1,050)). The finely pulverized product was processed by means of a multi-division classifier utilizing the Coanda effect (Elbow Jet Classifier, manufactured by Nittetsu Mining Co., Ltd.) to classify and remove fine powder and coarse powder simultaneously. As to the material toner base particles thus obtained, the weight-average particle diameter (D4) measured by the Coulter Counter method was 6.6 μm, and the cumulative value of the number-average distribution of toner base particles having diameters of less than 4 μm was 24.8% by number.

The material toner base particles were subjected to surface modification and removal of fine powder by the use of the surface modifying apparatus shown in FIG. 1, where, in this Example, sixteen (16) rectangular disks were placed at the upper part of the dispersing rotor, the space (gap) between the guide ring and the rectangular disks on the dispersing rotor was set to be 60 mm, and the space (gap) between the dispersing rotor and the liners was set to be 4 mm. Also, the rotational peripheral speed of the dispersing rotor was set to be 140 m/sec, and the blower air feed rate was set to be 30 $m^3$/min. The feed rate of the material toner base particles was set to be 300 kg/hr, and the cycle time was set to be 45 sec. The temperature of the refrigerant running through the jacket was set to be −15° C., and the cold-air temperature T1 was set to be −20° C. Still also, the number of revolutions of the classifying rotor was so controlled that the percentage of particles having diameters of from 0.6 μm or more to less than 3 μm came to be the desired value.

Through the foregoing steps, negatively chargeable Toner Base Particles 1 were obtained, whose weight-average particle diameter (D4) measured by the Coulter Counter method was 6.8 μm and the cumulative value of the number-average distribution of toner base particles having diameters of less than 4 μm was 18.6%. As to Toner Base Particles 1, the physical properties measured with FPIA-2100, the values of methanol concentrations with respect to transmittance of 780 nm wavelength light and the values measured with a scanning probe microscope are shown in Table 7 refers to the maximum vertical difference), and the methanol concentration-transmittance curve is shown in FIG. 3.

100 parts by weight of this toner base particles and 1.2 parts by weight of hydrophobic fine silica powder having been treated with hexamethyldisilazane and then with dimethylsilicone oil were mixed by means of Henschel mixer to prepare negatively chargeable Toner 1 (toner particles).

As to this Toner 1, the average circularity of the toner particles having a circle-equivalent diameter of from 3 μm or more to 400 μm or less as measured with FPIA-2100 was 0.949, and the average surface roughness measured with a scanning probe microscope was 18.6 nm.

Examples 2 to 9

Negatively chargeable Toners 2 to 9 were prepared in the same manner as in Toner 1 except that the binder resin and wax used were as shown in Table 6, further the fine grinding conditions for the Turbo Mill were changed as shown in Table 6, the classification conditions for the multi-division classifier were changed, and further the conditions for the surface modifying apparatus were set as shown in Table 6. Physical properties and so forth of the toner base particles were measured in the same manner as in Example 1. Results obtained are shown in Table 7.

Comparative Examples 1 to 2

Toners 10 and 11 were obtained in the same manner as in Toner 1 except that the binder resin, and wax used were as shown in Table 6, further the fine grinding conditions for the Turbo Mill were changed-as shown in Table 6, the classification conditions for the multi-division classifier were changed, and further the conditions for the surface modifying apparatus were changed as shown in Table 6. Physical properties and so forth of the toner base particles were measured in the same manner as in Example 1. Results obtained are shown in Table 7.

Of these, as to Toner 10, the average circularity of the toner particles having circle-equivalent diameters of from 3 μm or more to 400 μm or less as measured with FPIA-2100 was 0.931, and the average surface roughness measured with a scanning probe microscope was 27.1 nm.

Comparative Example 3

Toner 12 was prepared in the same manner as in Toner 1 except that the binder resin and wax used were as shown in Table 6, further the fine grinding conditions for the Turbo Mill were changed as shown in Table 6, the classification conditions for the multi-division classifier were changed, and the toner base particles obtained were passed through hot air of 300° C. instantaneously. Physical properties and so forth of the toner base particles were measured in the same manner as in Example 1. Results obtained are shown in Table 7.

Comparative Example 4

Toner 13 was prepared in the same manner as in Toner 1 except that the binder resin and wax used were as shown in Table 6, further the fine grinding conditions for Turbo Mill were changed as shown in Table 6, the classification conditions for the multi-division classifier were changed, and further the surface modification using the surface modifying apparatus was not carried out. Physical properties and so forth of the toner base particles were measured in the same manner as in Example 1. Results obtained are shown in Table 7.

Comparative Example 5

Toner 14 was prepared in the same manner as in Toner 1 except that the binder resin and wax used were as shown in Table 6, a jet stream grinding machine was used in place of the mechanical grinding machine, further the classification conditions for the multi-division classifier were changed, and the toner base particles obtained were passed through hot air of 300° C. instantaneously. Physical properties and so forth of the toner base particles were measured in the same manner as in Example 1. Results obtained are shown in Table 7.

Comparative Example 6

Toner 15 was prepared in the same manner as in Toner 1 except that the binder resin and wax used were as shown in Table 6, a jet stream grinding machine was used in place of the mechanical grinding machine, the classification conditions for the multi-division classifier were changed, and further the surface modification using the surface modifying apparatus was not carried out. Physical properties and so forth of the toner base particles were measured in the same manner as in Example 1. Results obtained are shown in Table 7.

TABLE 6

| Formulation of Toner, And Conditions/Results of Treatment | | | | | | | | | | | | | | |
|---|---|---|---|---|---|---|---|---|---|---|---|---|---|---|
| | | | | | | Before surface modification, toner base particles | | Surface modifying apparatus | | | | | Toner base particles after surface modification | |
| Toner | | | | Mechanical grinding machine | | Wt. av. par- | | Peripheral speed | | | Cold air | Classifying rotor rear | Wt. av. | |
| Base Par- ticles: | Binder Resin | Wax | Amt. (pbw) | air temp. T1 (° C.) | air temp. T2 (° C.) | ticle diam. (μm) | (1) (%) | Dispersing rotor --(m/sec)-- | Classifying rotor --(m/sec)-- | Cycle time (sec) | temp. T1 (° C.) | temp. T2 (° C.) | particle diam. (μm) | (1) (%) |
| 1 | 1 | 1 | (5) | 0 | 45 | 6.6 | 24.8 | 140 | 83 | 45 | −20 | 30 | 6.8 | 18.6 |
| 2 | 1 | 1 | (5) | 0 | 45 | 6.5 | 26.5 | 140 | 90 | 60 | −20 | 35 | 6.7 | 19.8 |
| 3 | 1 | 1 | (5) | 0 | 45 | 6.6 | 22.5 | 140 | 87 | 30 | −20 | 28 | 6.8 | 17.4 |
| 4 | 2 | 1 | (5) | 0 | 48 | 6.6 | 31.2 | 140 | 76 | 30 | −15 | 40 | 6.8 | 21.3 |
| 5 | 3 | 1 | (5) | 0 | 48 | 6.6 | 34.4 | 140 | 69 | 30 | −12 | 46 | 6.8 | 23.5 |

TABLE 6-continued

| Formulation of Toner, And Conditions/Results of Treatment | | | | | | | | | | | | | | |
|---|---|---|---|---|---|---|---|---|---|---|---|---|---|---|
| | | | | | | Before surface modification, toner base particles | | Surface modifying apparatus | | | | | Toner base particles after surface modification | |
| Toner Base Particles: | Binder Resin | Wax | Amt. (pbw) | Mechanical grinding machine air temp. T1 (° C.) | T2 (° C.) | Wt. av. particle diam. (μm) | (1) (%) | Peripheral speed Dispersing rotor --(m/sec)-- | Classifying rotor --(m/sec)-- | Cycle time (sec) | Cold air temp. T1 (° C.) | Classifying rotor rear temp. T2 (° C.) | Wt. av. particle diam. (μm) | (1) (%) |
| 6 | 2 | 2 | (2) | 0 | 45 | 6.7 | 25.6 | 135 | 76 | 45 | −15 | 37 | 6.8 | 18.4 |
| 7 | 3 | 2 | (2) | 0 | 45 | 6.7 | 28.5 | 145 | 76 | 50 | −15 | 31 | 6.9 | 19.6 |
| 8 | 4 | 2 | (2) | 3 | 48 | 6.5 | 38.0 | 135 | 69 | 50 | −12 | 48 | 6.9 | 20.3 |
| 9 | 5 | 3 | (2) | 3 | 48 | 6.8 | 38.0 | 140 | 69 | 50 | −12 | 45 | 6.7 | 24.8 |
| 10 | 6 | 4 | (2) | 3 | 48 | 6.6 | 38.3 | 135 | 69 | 50 | −12 | 43 | 6.7 | 25.6 |
| 11 | 7 | 4 | (2) | 3 | 48 | 6.7 | 38.2 | 135 | 69 | 50 | −12 | 43 | 6.7 | 25.4 |
| 12 | 1 | 4 | (2) | −20 | 25 | 6.8 | 20.0 | -------Hot air treatment----- | | | | | 6.8 | 20.0 |
| 13 | 1 | 4 | (2) | −20 | 25 | 6.7 | 21.3 | ----------(none)---------- | | | | | 6.7 | 21.3 |
| 14 | 1 | 4 | (2) | ---JSG---- | | 6.9 | 20.4 | -------Hot air treatment----- | | | | | 6.9 | 19.7 |
| 15 | 1 | 4 | (2) | ---JSG---- | | 6.8 | 20.8 | ----------(none)---------- | | | | | 6.8 | 20.5 |

(1): Cumulative value of number-average distribution of 4 μm or smaller particles JSG: Jet stream grinding

TABLE 7(A)

| | Toner base particle | | | | | | | | | |
|---|---|---|---|---|---|---|---|---|---|---|
| | Toner base particles and toner | Average circularity of ≧3 μm to ≦400 μm particles | Percentage of ≧0.6 μm to <3 μm particles (no. %) | Number cumulative value of <0.960 circularity toner base particles (%) | Methanol concentration at transmittance of: 80% (A) (vol. %) | 50% (B) (vol. %) | (B) − (A) (vol. %) | Average surface roughness (nm) | Maximum P − V dif. (nm) | Surface area ($\mu m^2$) |
| Example: | | | | | | | | | | |
| 1 | 1 | 0.949 | 14.2 | 43 | 50 | 52 | 2 | 14.6 | 130 | 1.20 |
| 2 | 2 | 0.952 | 3.2 | 35 | 51 | 54 | 3 | 11.2 | 103 | 1.18 |
| 3 | 3 | 0.942 | 6.3 | 60 | 48 | 52 | 4 | 22.3 | 195 | 1.23 |
| 4 | 4 | 0.939 | 16.2 | 64 | 42 | 47 | 5 | 28.5 | 218 | 1.28 |
| 5 | 5 | 0.956 | 15.1 | 33 | 59 | 64 | 5 | 9.9 | 88 | 1.09 |
| 6 | 6 | 0.937 | 16.0 | 66 | 40 | 47 | 7 | 30.2 | 232 | 1.30 |
| 7 | 7 | 0.963 | 15.5 | 28 | 60 | 67 | 7 | 7.8 | 62 | 1.05 |
| 8 | 8 | 0.935 | 18.5 | 68 | 40 | 50 | 10 | 34.1 | 241 | 1.34 |
| 9 | 9 | 0.965 | 19.0 | 25 | 61 | 72 | 11 | 6.1 | 48 | 1.06 |
| Comparative Example: | | | | | | | | | | |
| 1 | 10 | 0.931 | 20.1 | 68 | 40 | 55 | 15 | 38.2 | 255 | 1.40 |
| 2 | 11 | 0.934 | 20.3 | 70 | 39 | 57 | 18 | 37.1 | 248 | 1.38 |
| 3 | 12 | 0.974 | 26.8 | 14 | 64 | 84 | 20 | 3.9 | 38 | 1.02 |
| 4 | 13 | 0.928 | 30.5 | 77 | 32 | 54 | 22 | 42.3 | 310 | 1.55 |
| 5 | 14 | 0.977 | 39.4 | 10 | 58 | 76 | 18 | 2.5 | 25 | 1.01 |
| 6 | 15 | 0.912 | 52.5 | 80 | 43 | 67 | 24 | 48.8 | 402 | 1.65 |

Maximum P − V dif.: Maximum vertical difference

TABLE 7(B)

| | Toner | | | | | | | |
|---|---|---|---|---|---|---|---|---|
| | GPC molecular weight | | | Proportion of Mw of: 50,000 or more (%) | Proportion of Mw of: 3,000,000 or more (%) | Tg (° C.) | THF-insoluble matter (wt. %) | Acid value (mgKOH/g) |
| | Mw | Mn | Mp | | | | | |
| Example: | | | | | | | | |
| 1 | 94,000 | 6,800 | 13,700 | 15 | 0.5 | 54.0 | 31.2 | 8.0 |
| 2 | 94,000 | 6,800 | 13,700 | 15 | 0.5 | 54.0 | 31.2 | 8.0 |
| 3 | 94,000 | 6,800 | 13,700 | 15 | 0.5 | 54.0 | 31.2 | 8.0 |
| 4 | 120,000 | 9,800 | 15,200 | 13 | 0.3 | 56.0 | 35.2 | 1.4 |
| 5 | 76,000 | 7,000 | 12,000 | 16 | 0.8 | 53.5 | 23.5 | 30.2 |
| 6 | 120,000 | 9,800 | 15,200 | 13 | 0.3 | 56.0 | 35.2 | 1.4 |
| 7 | 76,000 | 7,000 | 12,000 | 16 | 0.8 | 53.5 | 23.5 | 30.2 |
| 8 | 150,000 | 11,500 | 19,000 | 11 | 0.2 | 56.8 | 46.0 | 0.8 |
| 9 | 67,000 | 5,300 | 9,400 | 20 | 1.0 | 53.2 | 8.4 | 35.1 |
| Comparative Example: | | | | | | | | |
| 1 | 135,000 | 7,600 | 23,400 | 35 | 0.3 | 53.6 | 0.0 | 0.0 |
| 2 | 76,000 | 7,600 | 13,100 | 40 | 0.0 | 52.0 | 0.0 | 6.8 |
| 3 | 94,000 | 6,800 | 13,700 | 15 | 0.5 | 56.3 | 31.0 | 5.5 |
| 4 | 94,000 | 6,800 | 13,700 | 15 | 0.5 | 56.3 | 31.0 | 5.5 |
| 5 | 94,000 | 6,800 | 13,700 | 15 | 0.5 | 56.3 | 31.0 | 5.5 |
| 6 | 94,000 | 6,800 | 13,700 | 15 | 0.5 | 56.3 | 31.0 | 5.5 |

Next, using Toners 1 to 14 thus prepared, evaluation was made in the following way. Eevaluation results are shown in Table 8.

Evaluation Machine:

Using a laser beam printer LASER JET 4300n, manufactured by Hewlett-Packard Co., the following evaluation was made.

(1) Toner Consumption:

Before and after a 18,000-sheet image reproduction test was conducted in a normal-temperature and normal-humidity environment (23° C./60% RH) at a print percentage of 4% on copying machine plain paper (A4 size, 75 g/m$^2$ in basis weight), the quantity of the toner in the toner container was measured to examine toner consumption per sheet of images.

(2) Check of Coarse Particles:

A suction hose was attached to the lower part of a testing sieve of 38 μm in mesh opening and 75 mm in mesh diameter, and 100 g of toner placed on the sieve was sucked. Where agglomerates are present, the toner is sucked while breaking up them with a spatula or the like. After making sure that all the toner on the sieve was sucked, coarse particles remaining on the sieve surface were tape-collected with a Mylar tape. This tape was stuck to a sheet of copying machine plain paper (A4 size, 75 g/m$^2$ in basis weight), and observed with a microscope (e.g., a wide-stand microscope of 100 magnifications and 1.2 mm in measurement range) to make evaluation.

A: Coarse particles are little present in the visual field.

B: Coarse particles are slightly present in the visual field.

C: A few coarse particles are present in the visual field.

D: Ten or so coarse particles are present in the visual field.

E: Hundreds of particles are present in the visual field.

Low-Temperature Fixing Performance, High-Temperature Anti-Offset Properties:

The toner was put into a process cartridge, and LASER JET 4300n, manufactured by Hewlett-Packard Co., was used which was so modified that its fixing assembly was detached and the surface temperature of its heating roller was so made as to be changeable in the range from 120° C. to 250° C. externally by means of a fixing tester fitted with an external drive means and a fixing assembly temperature control unit and further that the print speed was increased by 1.1 times. Solid black images were fixed feeding recording mediums. Changing preset temperature at 5° C. intervals, an image sample of solid black images was printed in a normal-temperature and normal-humidity environment (25° C./60% RH).

(3) Low-Temperature Fixing Performance:

Fixed images were rubbed with soft thin paper under application of a load of 4.9 kPa (50 g/cm$^2$) The lowest temperature at which the rate (%) of a decrease in image density before and after the rubbing was 10% or less was regarded as the lowest fixing temperature. Here. copying machine plane paper severe in fixing (90 g/m$^2$ in basis weight) was used as test paper.

(4) High-Temperature Anti-Offset Properties:

An image the upper half of which has a pattern comprised of 100 μm wide horizontal-lines (100 μm in width and 100 μm in interval) and solid black and the lower half of which is white was printed, and the maximum temperature at which no stain appeared on the white image was detected. Copying machine plane paper on which offset tends to occur (60 g/m$^2$ in basis weight) was used as test paper.

(5) Anti-Blocking Properties:

The toner was weighed in an amount of 10 g in a polypropylene cup, and its surface was leveled. Thereafter, powdered-medicine wrapping paper was spread and put thereon and 10 g of an iron powder carrier was further placed thereon, which was left for 5 days in an environment of 50° C. and 0% RH, and evaluation was made on the blocking state of the toner.

A: The toner flows smoothly when the cup is inclined.

B: While the cup is turned, the toner surface begins to crumble little by little to become smooth powder.

C: The toner surface crumbles upon application of force from the outside while the cup is turned, and begins to flow smoothly before long.

D: Blocking balls are formed. They crumble when poked with something sharp.

E: Blocking balls are formed. They can not easily crumble even when poked.

(6) Image Density, Fog:

In each environment of a low-temperature and low-humidity environment (15° C./10% RH) and a high-temperature and high-humidity environment (32.5° C./80% RH), a 4,500-sheet image reproduction test was conducted at a print speed of 1 sheet/10 seconds, in a print percentage of 5%, on copying machine plain paper (A4 size, 75 g/m$^2$ in basis weight), and for 4 days, i.e., on 18,000 sheets in total.

The image density was measured with MACBETH REFLECTION DENSITOMETER (manufactured by Macbeth Co.), as relative density with respect to an image printed on a white background area with a density of 0.00 of an original.

The fog was calculated from the difference between the whiteness of a transfer sheet and the whiteness of the transfer sheet after printing solid white, which were measured with a reflectometer manufactured by Tokyo Denshoku Co., Ltd.

Figure 4:
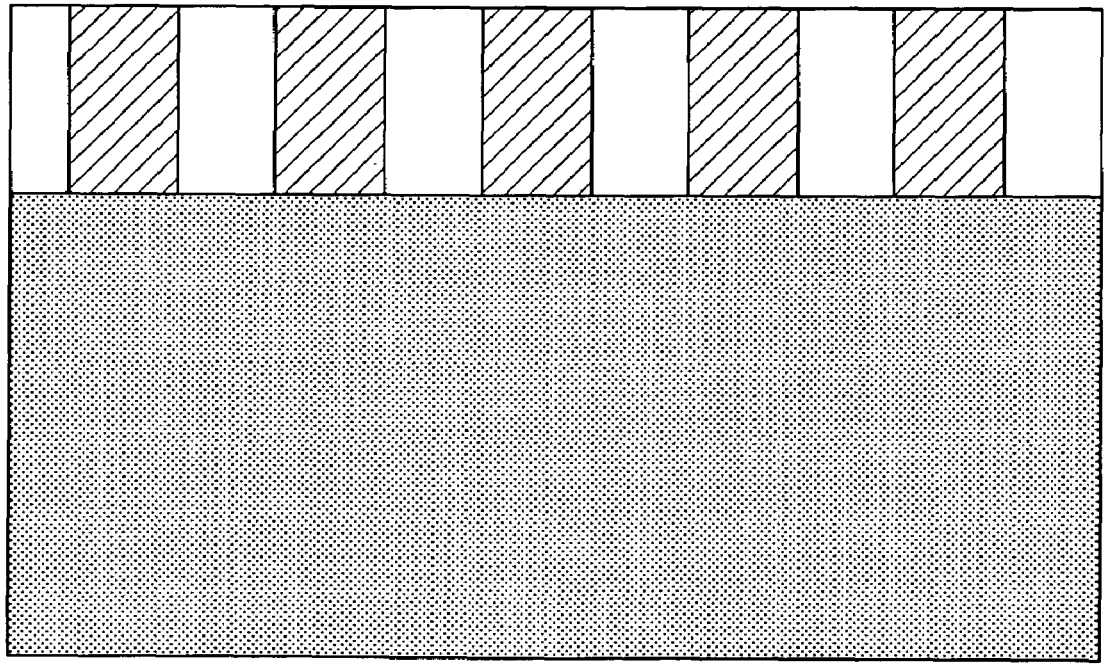
FIG. 4 illustrates a pattern used for evaluating sleeve ghost.

(7) Sleeve Negative Ghost:

Images were printed on 18,000 sheets of usual copying machine plain paper (A4 size, 75 g/m$^2$ in basis weight) in a low-temperature and low-humidity environment (15° C./10% RH). Evaluation on sleeve negative ghost was made at an interval of 4,500 sheets. For image evaluation in regard to ghost, solid black stripes were reproduced for only one round of the sleeve and thereafter a halftone image was reproduced. The pattern of the halftone image is schematically shown in FIG. 4. The evaluation method was as follows: in a sheet of images printed in the second round of the sleeve, a reflection density (1) and a reflection density (2) were measured with the Macbeth reflection densitometer respectively at a place where a solid black image was formed in the first round of the sleeve (black print area) and at a place where a solid black image was not formed in the first round of the sleeve (non-image area), and the difference between the reflection density (1) and the reflection density (2) was calculated as shown below. The negative ghost is a ghost phenomenon in which, usually in the image formed in the second round of the sleeve, the image density at the black print area in the first round of the sleeve is lower than the image density at the non-image area in the first round of the sleeve, and the shape of the pattern reproduced in the first round appears as such.

Reflection density difference=(reflection density at a place having uindergone image formation)−(reflection density at a place not having undergone image formation).

The smaller the difference in the reflection density is, the less the ghost appears and the better the grade is. As the overall evaluation of the ghost, evaluation was made according to four ranks of A, B, C and D. The worst evaluation result at an interval of 4,500 sheets is shown.

A: Reflection density difference is 0.00 or more to less than 0.02.

B: Reflection density difference is 0.02 or more to less than 0.04.

C: Reflection density difference is 0.04 or more to less than 0.06.

D: Reflection density difference is 0.06 or more.

(8) Spots Around Line Images:

In the running test in the low-temperature and low-humidity environment, a lattice pattern with 100 μm (latent image) lines (1 cm in interval) was printed at the initial stage and at the 18,000th sheet, and the scattering state of spots around line images were visually inspected with an optical microscope.

A: Lines are very sharp and spots around line images are little seen.

B: Spots around line images are slightly seen, and lines are relatively sharp.

C: Spots around line images are a little many, and lines look somewhat blurred.

D: Not reach the level of C.

(9) Blotches:

In the running test in the low-temperature and low-humidity environment, the evaluation on blotches was carried out on the basis of the toner coat state on the developing sleeve during image reproduction and printed images.

A: No blotches are seen at all on the developing sleeve.

B: Blotches are slightly seen on the developing sleeve, but their influence does not appear on images.

C: Blotches are seen on the developing sleeve, and their influence appears faintly on images.

D: Blotches are seen on the developing sleeve, and their influence appear greatly on images.

TABLE 8

Toner Evaluation Results

| | Toner consumption (mg/sh.) | Coarse particles | Fixing performance (° C.) | Anti-offset (° C.) | Anti-blocking | Low-temp./low-humidity environment (1) | (2) | (3) | Image density Initial stage | Image density 18,000 sheets | Fog on 18,000th sheet | High-temp./high-humidity environment Image density Initial stage | Image density 18,000 sheets |
|---|---|---|---|---|---|---|---|---|---|---|---|---|---|
| Example: | | | | | | | | | | | | | |
| 1 | 41 | A | 140 | 250 | A | A | A | A | 1.45 | 1.44 | 0.5 | 1.48 | 1.46 |
| 2 | 41 | A | 140 | 250 | A | A | A | A | 1.43 | 1.40 | 0.7 | 1.46 | 1.44 |
| 3 | 42 | A | 140 | 250 | A | A | A | A | 1.42 | 1.40 | 0.8 | 1.44 | 1.42 |
| 4 | 45 | B | 145 | 250 | A | A | B | A | 1.40 | 1.37 | 1.1 | 1.42 | 1.39 |
| 5 | 44 | B | 140 | 240 | B | A | B | A | 1.41 | 1.36 | 1.0 | 1.41 | 1.36 |
| 6 | 46 | B | 150 | 245 | A | A | B | B | 1.41 | 1.35 | 1.3 | 1.41 | 1.32 |
| 7 | 44 | B | 145 | 235 | B | B | B | A | 1.41 | 1.34 | 1.2 | 1.40 | 1.33 |

TABLE 8-continued

| | Toner Evaluation Results | | | | | | | | | | | | |
|---|---|---|---|---|---|---|---|---|---|---|---|---|---|
| | | | | | | Low-temp./low-humidity environment | | | | | | High-temp./ high-humidity environment | |
| | Toner | | Fixing | Anti- | | | | | Image density | | Fog on | Image density | |
| | consumption (mg/sh.) | Coarse particles | performance (° C.) | offset (° C.) | Anti-blocking | (1) | (2) | (3) | Initial stage | 18,000 sheets | 18,000th sheet | Initial stage | 18,000 sheets |
| 8 | 50 | C | 150 | 240 | A | B | C | C | 1.35 | 1.29 | 1.6 | 1.36 | 1.28 |
| 9 | 46 | B | 150 | 235 | C | C | C | B | 1.38 | 1.29 | 1.8 | 1.39 | 1.28 |
| Comparative Example: | | | | | | | | | | | | | |
| 1 | 51 | C | 160 | 230 | D | B | C | C | 1.30 | 1.20 | 2.1 | 1.32 | 1.20 |
| 2 | 51 | C | 155 | 230 | E | B | C | C | 1.25 | 1.18 | 2.5 | 1.26 | 1.18 |
| 3 | 51 | D | 155 | 240 | C | D | D | D | 1.13 | 1.05 | 2.6 | 1.14 | 1.06 |
| 4 | 53 | E | 155 | 240 | C | C | D | D | 1.10 | 1.04 | 2.9 | 1.11 | 1.04 |
| 5 | 54 | D | 155 | 240 | C | D | D | D | 1.09 | 1.00 | 2.6 | 1.00 | 0.99 |
| 6 | 56 | E | 155 | 240 | C | D | D | D | 1.05 | 0.98 | 3.5 | 1.06 | 0.96 |

(1): Blotch;
(2): Negative ghost;
(3) Spots around line images

This application claims priority from Japanese Patent Application No. 2003-205315 filed on Aug. 1, 2003, which is hereby incorporated by reference herein.

What is claimed is:

1. A toner comprising toner particles which comprise toner base particles containing at least a binder resin, a magnetic material and inorganic fine particles, wherein;

said toner base particles having a circle-equivalent diameter of from 3 μm or more to 400 μm or less as measured with a flow type particle image analyzer have an average circularity of from 0.935 or more to less than 0.970;

said toner base particles have an average surface roughness of from 5.0 nm or more to less than 35.0 nm as measured with a scanning probe microscope; and said binder resin contains at least a vinyl resin having a carboxyl group and a vinyl resin having as partial structure a linkage formed by the reaction of a carboxyl group with an epoxy group.

2. The toner according to claim 1, wherein, in number-base particle size distribution of said toner base particles having a circle-equivalent diameter of from 0.6 μm or more to 400 μm or less as measured with the flow type particle image analyzer, said toner base particles of from 0.6 μm or more to less than 3 μm are in a percentage of from 0% by number or more to less than 20% by number.

3. The toner according to claim 1, wherein, in wettability of said toner base particles to a methanol/water mixed solvent when transmittance of 780 nm wavelength light is 80% and 50%, methanol concentration in the methanol/water mixed solvent is from 35% by volume to 75% by volume.

4. The toner according to claim 1, wherein said toner base particles are particles obtained through a process in which toner constituent materials are mixed, thereafter the mixture obtained is kneaded by means of a heat kneading machine, the kneaded product is cooled to solidify, then crushed, followed by pulverization, and thereafter the resultant toner base particles are subjected to surface modification and removal of fine powder simultaneously by means of a surface modifying apparatus.

5. The toner according to claim 1, wherein a number cumulative value of said toner base particles having a circularity of less than 0.960 is 20% by number or more to less than 70% by number.

6. The toner according to claim 1, wherein said toner base particles have a maximum vertical difference of from 50 nm or more to less than 250 nm as measured with a scanning probe microscope.

7. The toner according to claim 1, wherein said toner base particles have surface area of from 1.03 $\mu m^2$ or more to less than 1.33 $\mu m^2$ in a 1 μm square on the particle surface as measured with a scanning probe microscope.

8. The toner according to claim 1, which has, in molecular weight distribution of tetrahydrofuran-soluble matter of the toner as measured by gel permeation chromatography, a number-average molecular weight of from 1,000 to 40,000 and a weight-average molecular weight of from 10,000 to 1,000,000.

9. The toner according to claim 1, which has, in molecular weight distribution of tetrahydrofuran-soluble matter of the toner as measured by gel permeation chromatography, a main peak in a region of molecular weight of from 4,000 to 30,000.

10. The toner according to claim 1, which has, in molecular weight distribution of tetrahydroftiran-soluble matter of the toner as measured by gel permeation chromatography, a main peak in the region of molecular weight of from 4,000 to 30,000, and has at least one sub-peak or shoulder in the region of molecular weight of from 50,000 to 20,000,000, where an area of a region of molecular weight of 50,000 or more is in a proportion of from 1% to 50% to an area of the whole region and an area of a region of molecular weight of 3,000,000 or more is in a proportion of from 0% to 20% to the area of the whole region.

11. The toner according to claim 1, which contains tetrahydrofuran-insoluble matter in an amount of from 0.1% by weight to 60% by weight based on said binder resin.

12. The toner according to claim 1, wherein the tetrahydrofuran-soluble matter has an acid value of less than 50 mg·KOH/g.

* * * * *

UNITED STATES PATENT AND TRADEMARK OFFICE

CERTIFICATE OF CORRECTION

PATENT NO. : 7,288,354 B2 
APPLICATION NO. : 10/902072
DATED : October 30, 2007
INVENTOR(S) : Shuhei Moribe et al.

It is certified that error appears in the above-identified patent and that said Letters Patent is hereby corrected as shown below:

COLUMN 8:

Line 21, "$1.07m^2$." should read --$1.07\mu m^2$--; and "$1.28m^2$," should read --$1.28\mu m^2$,--.

COLUMN 22:

Line 59, "a-me-" should read --α-me- --.

COLUMN 24:

Line 59, "$A^+$" should read --$A'^+$--.

COLUMN 44:

Line 45, "Resin: Vinyl
Vinyl" should read --Resin:--.

COLUMN 47:

Line 24, "changed-as" should read --changed as--.

COLUMN 52:

Line 41, "(50 $g/cm^2$)" should read --(50 $g/cm^2$).--.

Signed and Sealed this

Eleventh Day of November, 2008

JON W. DUDAS
*Director of the United States Patent and Trademark Office*